US007926207B2

(12) United States Patent
Lopez Almendros et al.

(10) Patent No.: US 7,926,207 B2
(45) Date of Patent: Apr. 19, 2011

(54) WEAR ASSEMBLY AND COMPONENTS THEREOF, WHICH IS INTENDED FOR MACHINES THAT ARE USED TO MOVE MATERIALS SUCH AS EARTH AND STONES

(75) Inventors: José Lopez Almendros, Barcelona (ES); Franceso Perez Lado, Palamos (ES); Roberto Fernandez Munoz, El Masnou (ES)

(73) Assignee: Metalogenia, S.A., Barcelona (ES)

( * ) Notice: Subject to any disclaimer, the term of this patent is extended or adjusted under 35 U.S.C. 154(b) by 1021 days.

(21) Appl. No.: 10/581,672

(22) PCT Filed: Dec. 5, 2003

(86) PCT No.: PCT/ES03/00623

§ 371 (c)(1),
(2), (4) Date: Apr. 4, 2007

(87) PCT Pub. No.: WO2005/056934

PCT Pub. Date: Jun. 23, 2005

(65) Prior Publication Data

US 2008/0028644 A1 Feb. 7, 2008

(51) Int. Cl.
*E02F 9/28* (2006.01)

(52) U.S. Cl. ..... 37/452; 37/456; 172/772; 403/374.4

(58) Field of Classification Search ..... 37/446–460
See application file for complete search history.

(56) References Cited

U.S. PATENT DOCUMENTS

| | | | | | |
|---|---|---|---|---|---|
| 2,915,290 | A | * | 12/1959 | Petersen | 175/392 |
| 3,079,710 | A | * | 3/1963 | Larsen et al. | 37/455 |
| 3,091,044 | A | * | 5/1963 | Meyer et al. | 37/456 |
| 3,117,386 | A | * | 1/1964 | Ferwerda | 37/454 |
| 3,196,956 | A | * | 7/1965 | Ratkowski | 172/713 |
| 3,508,352 | A | * | 4/1970 | Radwill | 37/455 |
| 3,704,753 | A | * | 12/1972 | Hasforth et al. | 172/700 |
| 3,774,324 | A | * | 11/1973 | Lafond | 37/457 |
| 4,231,173 | A | * | 11/1980 | Davis | 37/457 |
| 4,335,532 | A | * | 6/1982 | Hahn et al. | 37/459 |
| 4,338,736 | A | * | 7/1982 | Radigan | 37/458 |
| 4,404,760 | A | * | 9/1983 | Hahn et al. | 37/459 |
| 4,481,728 | A | * | 11/1984 | Mulder et al. | 37/452 |
| 4,727,663 | A | * | 3/1988 | Hahn | 37/458 |
| 5,068,986 | A | * | 12/1991 | Jones | 37/457 |
| 5,144,762 | A | * | 9/1992 | Robinson | 37/457 |
| 5,423,138 | A | * | 6/1995 | Livesay et al. | 37/456 |
| 5,456,029 | A | * | 10/1995 | Cornelius | 37/456 |

(Continued)

FOREIGN PATENT DOCUMENTS

WO WO 9418401 A1 * 8/1994

*Primary Examiner* — Thomas A Beach
(74) *Attorney, Agent, or Firm* — Sughrue Mion, PLLC

(57) ABSTRACT

The present invention relates to a wear assembly, as well as to the different components thereof, which has a wear member or tooth and an adaptor member or tooth bar for wear applications in a machine for moving materials such as earth and stones. The invention contemplates a wear assembly and particularly a coupling system between the different components to one another by a characteristic coupling system and at least one retention system assuring the coupling and anchor between the different components, specifically between the wear member and adaptor, the latter in turn being joined to the blade of a bucket or scoop of a machine for moving materials, such as an excavator or the like.

26 Claims, 27 Drawing Sheets

U.S. PATENT DOCUMENTS

| | | | | |
|---|---|---|---|---|
| 5,561,925 | A * | 10/1996 | Livesay | 37/455 |
| 5,709,043 | A * | 1/1998 | Jones et al. | 37/458 |
| 5,918,391 | A * | 7/1999 | Vinas Peya | 37/452 |
| 6,047,487 | A * | 4/2000 | Clendenning | 37/452 |
| 6,079,132 | A * | 6/2000 | Clendenning | 37/457 |
| 6,321,471 | B2 * | 11/2001 | Fernandez Munoz et al. | 37/456 |
| H2020 | H * | 5/2002 | Kesavan et al. | 37/455 |
| 6,393,739 | B1 * | 5/2002 | Shamblin et al. | 37/456 |
| 6,477,796 | B1 * | 11/2002 | Cornelius | 37/452 |
| 6,708,431 | B2 * | 3/2004 | Robinson et al. | 37/456 |
| 6,799,386 | B2 * | 10/2004 | Robinson et al. | 37/452 |
| 6,865,828 | B1 * | 3/2005 | Molino et al. | 37/454 |
| RE40,336 | E * | 5/2008 | Fernandez Munoz et al. | 37/456 |
| 7,658,024 | B2 * | 2/2010 | Launder et al. | 37/454 |
| 7,703,224 | B2 * | 4/2010 | Karlsson et al. | 37/457 |
| 2006/0143953 | A1 * | 7/2006 | Karlsson et al. | 37/456 |
| 2007/0084094 | A1 * | 4/2007 | Bentley | 37/452 |
| 2007/0193075 | A1 * | 8/2007 | Carpenter | 37/452 |

* cited by examiner

WEAR ASSEMBLY AND COMPONENTS THEREOF, WHICH IS INTENDED FOR MACHINES THAT ARE USED TO MOVE MATERIALS SUCH AS EARTH AND STONES

CROSS-REFERENCE TO RELATED APPLICATION

This application is a 371 of PCT/ES2003/000623, filed Dec. 5, 2003; the disclosure of which is incorporated herein by reference.

FIELD OF THE INVENTION

The present invention relates to a wear assembly and to the different components thereof, which comprises a wear member or tooth and adaptor member or tooth bar, for wear applications in a machine for moving materials such as earth and stones, The invention contemplates a wear assembly and particularly a coupling system between the different components by means of a characteristic coupling system and at least one retention system assuring the coupling and anchoring between the different components, specifically between the wear member and adaptor, the latter in turn being joined to the blade of a front edge of a bucket or scoop of a machine for moving materials, such as an excavator or the like.

The present invention also relates therefore to a wear member or tooth and to an adaptor member or tooth bar forming part of said wear assembly and incorporating respective parts of said mutual coupling and anchoring system.

TECHNICAL BACKGROUND

Machines for moving materials such as earth and stones, included among which are excavators and the like, and other machines used in public works and mining, are used to pull out, move and load earth and stones. These machines, which can be presented with a variety of configurations, are usually provided with one or more buckets joined to a mechanical arm. The bucket is provided with a beveled lip or blade on a front edge intended for striking against and penetrating the earth and stone mass. It is common to assemble wear members or teeth associated to the blade and projecting forwardly therefrom to prevent excessive wear of the blade and to aid in penetrating the earth. However, said blades are also subjected to wear and breaks, whereby they must often be replaced, and on the other hand, depending on the work which the machine is to perform, it may be desirable to change the type or shape of the teeth. To facilitate said replacement, wear member and adaptor member, tooth and tooth bar, assemblies are used in which the tooth bars are fixed to the blade of the bucket in a more or less permanent manner and the teeth are releasably coupled to the tooth bar by means of respective interlocking configurations. The coupling is held together by means of at least one pin or other retainer member.

There are different types of coupling systems between teeth and tooth bars, it being common in most of them that upon applying a downward vertical force on the front part of the tip of the tooth, reactive forces are generated due to the structure of the coupling that are contrary to the direction of the coupling between tooth and tooth bar. That is, forces are generated which tend to "decouple" both members, considerably increasing stresses both on the surface of the tooth bar and in the pin securing the interlocking between both members.

In traditional interlocking systems between a wear piece and an adaptor member thereof, or a tooth and tooth bar, the housing in the tooth and the nose of the tooth bar have a wedge shape. This shape creates stresses when a downward vertical force is applied (usual manner of the work of the machine) on the tip of the tooth which tend to separate the tooth from the tooth bar, subjecting the pin retaining both members to great stress (see FIG. 9*a*).

Patent document U.S. Pat. No. 4,761,900 discloses a tooth and tooth bar assembly for an excavator in which a slightly arched pin is used to hold the coupling between the tooth and tooth bar and a retainer member is used to lock the pin.

The pin used has a rectangular cross section with rounded corners and has two opposite planar faces and two opposite arched faces of different radii, such that the cross section area decreases from a middle area towards the ends. About halfway between the ends of one of the planar faces there is a cavity for housing said retainer member, which is joined to a plate from which there is projected towards the opposite part a rod surrounded by a compressed coil spring, which is supported on said plate at one end and joined to a base disc at the other end. The spring is embedded in an elastomeric material forming a cylinder between the plate and base disc, constituting a retractable and at the same time dust, dirt and moisture resistant one-piece body. The one-piece body is housed in a cavity opening into a wall of the tooth bar such that in the absence of stresses, the retainer member projects from said wall. As the pin is introduced in a passage defined in collaboration by respective configurations of the tooth and tooth bar when they are coupled together, a beveled end of the pin acts like a cam on the head of the retainer member such that the retractable body is shortened and the retainer member is hidden, allowing the passage of the pin. When said cavity of the pin reaches a position ahead of the retainer member, the latter penetrates therein, pushed by the resilient force of the spring holding the pin in place.

One drawback of the device of this patent U.S. Pat. No. 4,761,900 is that the insertion of the pin must be carried out by means of hammering to achieve the shortening of the retainer member against the force of the spring and the tightening of the wider cross section middle area of the pin. Although the retainer member has a cone-shaped tip cooperating with inclined walls of the housing of the pin, hammering must be used also for the removal of the tooth in order to achieve the shortening of the retainer member. In a general sense, hammering is usually imprecise with respect to force and direction and can damage or weaken members of the tooth, tooth bar, pin and/or retainer member, therefore an assembly device not requiring hammering for carrying it out is desirable.

In order for the pin to be retained in the tooth-tooth bar coupling system in this retention system, the pin is supported in the tooth and tooth bar, such that it is essential that there not be any allowance between the tooth and tooth bar so that the pin is held in place, a retainer member further being necessary. Even though the allowance between new parts is nonexistent, as teeth are changed in the tooth bar the allowance becomes greater since, in spite of the tooth being new, the tooth bar has become deformed due to the work of the previous, replaced teeth. As this allowance increases, the retainer member looses effectiveness since the tension exerted on the pin decreases, whereby the risk of loosing the pin and accordingly the wear member or tooth exists.

Patent document U.S. Pat. No. 5,983,534 discloses a lock system for a fixing pin of the coupling between a tooth and tooth bar which is rotary and does not require hammering.

In the described system, the pin incorporates a resiliently loaded member able to exert a force against one portion of the tooth or tooth bar for the purpose of tightening the socket coupling between both, and a resiliently loaded retainer member radially projecting from a cylindrical wall of the pin and susceptible to being introduced in a cavity of the tooth or tooth bar when the pin, once inserted, is rotated a predetermined angle by means of the coupling of a tool in suitable configuration provided on an axial end of the pin. A notch allows the introduction of the retainer member when the pin is axially inserted into a passage defined in collaboration by respective configurations of the tooth and tooth bar when they are both coupled. When the pin is inserted, a sloped surface acts as a cam to push the retainer member inwardly of the pin as the latter is rotated until reaching the angular position of said cavity, where the retainer member is shot into the cavity due to the effect of said resilient loading. The removal thereof is provided for by either breaking of the retainer member due to the action of striking with a hammer on the pin in the axial direction or the collaboration of inclined surfaces of the housing with corresponding inclined surfaces of the head of the retainer member to push the retainer member inwardly, either by an axial force exerted on the pin, or by a turning torque applied thereto.

This arrangement entails great complexity for the pin, since it incorporates two moving parts housed and retained in respective cavities of the body of the pin and resiliently loaded by means of coil springs, which negatively affects its production cost. On the other hand, said cavities existing in the pin for the housing of the moving parts weaken the pin. Furthermore, the moving parts and resilient springs housed in the pin are highly susceptible to being affected by the accumulation of dust and earth, which combined with moisture can form a clay-type paste which may lock the springs and the movement possibilities of the moving parts when it dries, which entails the need to destroy them by hammering when it is necessary to remove the teeth. Another drawback resides in that the use of the pressure of the resiliently loaded member against the tooth bar for holding the pin in place allows a certain relative movement between the tooth and tooth bar. As a result, the retainer is exposed to the movements of the tooth and, accordingly, the retainer may become deformed.

BRIEF EXPLANATION OF THE INVENTION

The object of the present invention is to provide a wear assembly and particularly a coupling system between the different components of said assembly (adaptor member or tooth bar and wear member or tooth) for excavators and the like, in which to optimize the use of such members and facilitate renewal or replacement thereof, a system with mechanical couplings with innovative solutions (interlocking configurations and pin-type fixing members) is provided.

This means that once the bucket is prepared in the shop, all the members subjected to the wear action can be replaced by other new members at the work site, which may be a quarry face located far from maintenance shops, without needing to use blow torches, welding or specialized personnel. To that end, all the mentioned components can be fixed with interlocking members and pins so that the replacement operations are simple, using few tools and preventing the use of complex equipment.

The excavator tooth couplings must comply with the following features:

a) they must withstand mechanical stresses from the transmission of forces from the bucket-tooth bar-tooth assembly with the ground;

b) the useful life of the coupling itself is limited due to phenomena of:

plastic deformation of the material due to the reactions for counteracting the exerted forces;

fatigue: it is calculated that a tooth with normal duration performs more than 50,000 work cycles; because of this, the coupling must be designed to prevent defects occurring due to fatigue phenomena such as cracks or others;

wear, being necessary to distinguish two types of wear:

1. external wear of the parts due to the flux of the material;
2. internal wear due to the fine materials which are introduced between the two members (tooth-tooth bar) and an abrasive effect with the movements between the two parts that occurs, which wears the members.

Another object of the present invention is to have, in addition to the mentioned wear assembly, a wear member or tooth as well as an adaptor member or tooth bar which, due to their configuration, allow a distribution of stresses favoring the retention of the tooth in the tooth bar as well as reducing the stresses to which the retention system and specifically the pin thereof are subjected.

For the conception of the tooth and tooth bar assembly according to the invention, it has been taken into account that the introduction of the tooth in the tooth bar requires carrying out a curvilinear motion to overcome two opposing areas characteristic of the coupling system and of the structure of the tooth and tooth bar. Said opposing areas are constituted of two interlocking surfaces determined by the superimposition area existing between the combination of lower surfaces of revolution of the nose of the tooth bar and the upper surfaces of revolution of the nose of the tooth bar. The same occurs in the hollow of the tooth. There must be slippage in the upper faces of the tooth and tooth bar and when the opposing areas are facing, the slope of these areas must be less than the incremental reduction of the section in the forward introduction movement. It is thus possible to obtain two bodies with a perfect male-female reproduction which, once interlocked, have areas in opposition without a natural release.

Retention of the tooth in the tooth bar is due to the combination of the inclination of the planes defining the defined interlocking surfaces and to the shape of said planes. According to the shape of said planes, a tightening or crushing effect between the tooth and tooth bar will be achieved when a downward vertical force is applied on the tip of the tooth, this being the usual working condition of the machine, in addition to a retention effect achieved due to the inclination of the planes.

Due to this interlocking system, the pin is subjected to smaller stresses than in traditional interlocking systems since the tooth-tooth bar system self-tightens as it is subjected to downward vertical loads on the tip of the tooth, freeing the retention system and its pin from stresses and therefore allowing designing the pins of the retention system with a smaller size and section since they are subjected to fewer stresses.

Once the tooth is introduced in the tooth bar, when a normal force is applied in a longitudinal direction when the machine performs backward movement operations, the tooth does not come out of the tooth bar since the two interlocking surfaces of both members are in opposition, thus offsetting the expulsion forces to which the tooth is subjected in the traditional interlockings. It is necessary to apply a force with two components following the previously described curvilinear movement in order to extract the tooth.

In high output applications (mines and large quarries) when the land is extraordinarily abrasive, a three-part system is provided, i.e. an intermediate tooth bar-tooth assembly and changeable spare tip. The interlocking between the intermediate tooth and the changeable spare tip will be the same as between the tooth bar and the intermediate tooth with a configuration adapted to the geometry (it will usually be compressed lengthwise) in order to allow a changeable interlocking on the tip of the tooth.

Another object of the present invention is also to have a retention system and variations thereof adapted to the constitution and structure of the interlocking as well as to its different applications. Said retention system can also be used in other wear assemblies.

The pin used in this retention system has as one of its main features the fact that it is releasable without the use of hammering for the introduction or extraction. Likewise, the pin used by the retention system object of the present invention only requires the tooth bar for its retention, not being affected by the allowance created between the tooth and tooth bar due to the consecutive changing of teeth in the same tooth bar, i.e. despite the tooth bar being subjected to deformation, the pin will be held in place as the retention system does not depend on the allowance between tooth and tooth bar. The retention system and housing or interlocking solutions to which it is associated can generally be used for joining any of the members, i.e.: blade, tooth bar, intermediate tooth or changeable spare tip, although they will be described in a specific area or application of the assembly.

The essential features of the invention are detailed in claim 1 for the wear member or tooth, in claim 13 for the adaptor member or tooth bar, in claim 24 for the wear assembly formed by a wear member and an adaptor, and in claim 25 for the retention system.

Other features and particularly those pertaining to several configurations of the parts of the assembly as well as the different variations of the retention system used for fixing the parts of the assembly are detailed in the dependent claims.

BRIEF DESCRIPTION OF THE DRAWINGS

The previous and other advantages and features will be better understood from the following detailed description of several embodiments, with reference to the attached drawings, in which.

DETAILED DESCRIPTION OF SEVERAL EMBODIMENTS

Figure 1:
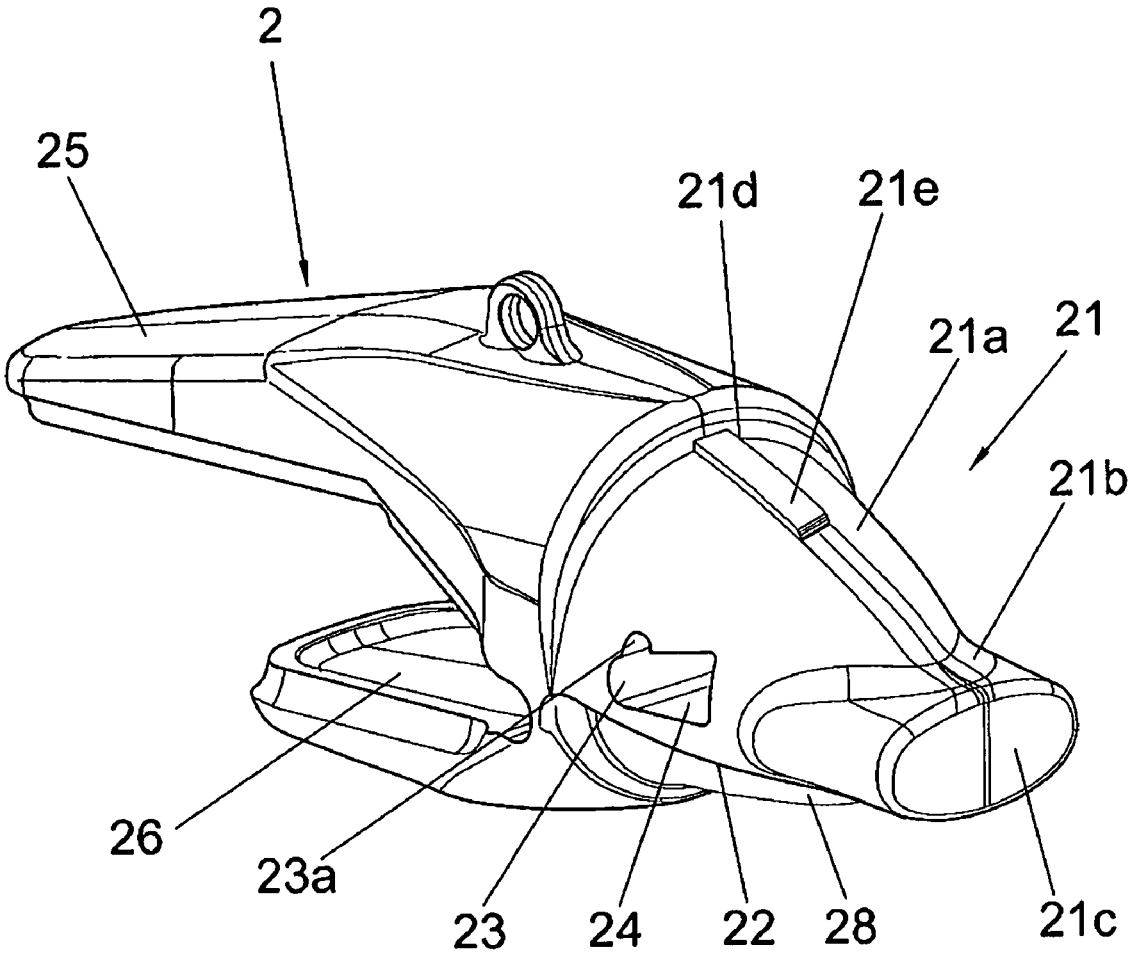
FIG. 1 shows a perspective view of an adaptor member or tooth bar according to the invention.
Figure 2:
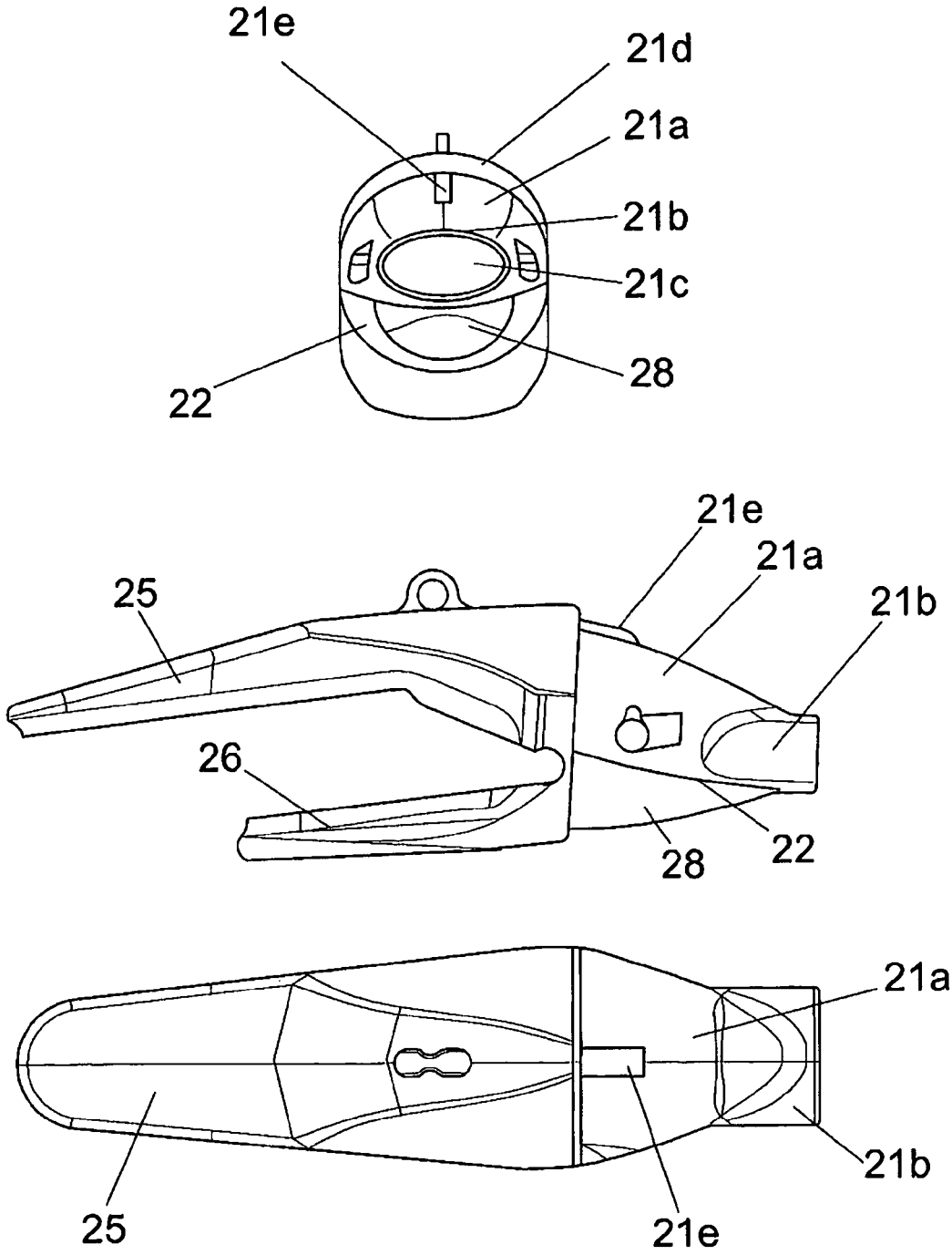
FIG. 2 shows frontal, side and upper views of the tooth bar of FIG. 1.
Figure 2A:
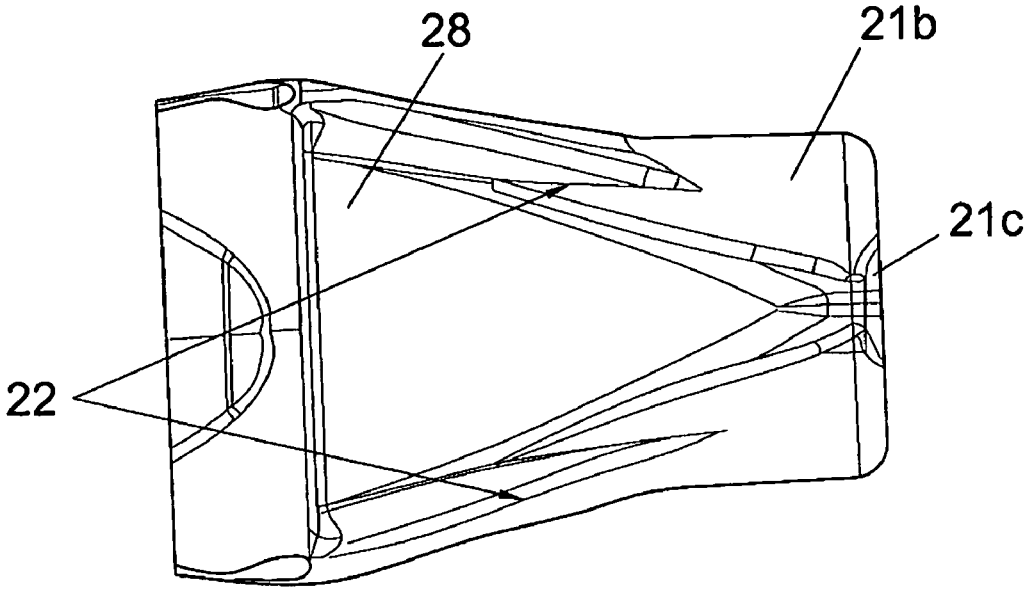
FIG. 2*a* shows a bottom view of the nose of the tooth bar of FIG. 1 in which the interlocking surfaces are observed.
Figure 2B:
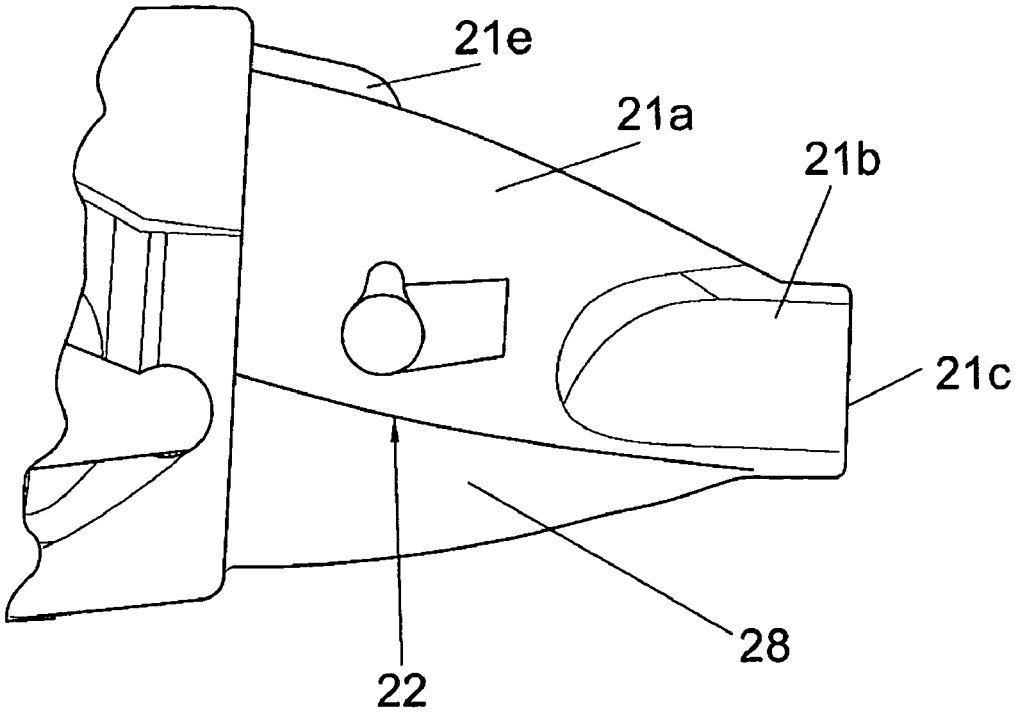
FIG. 2*b* represents a side view of the nose of the tooth bar of FIG. 1.
Figure 3:
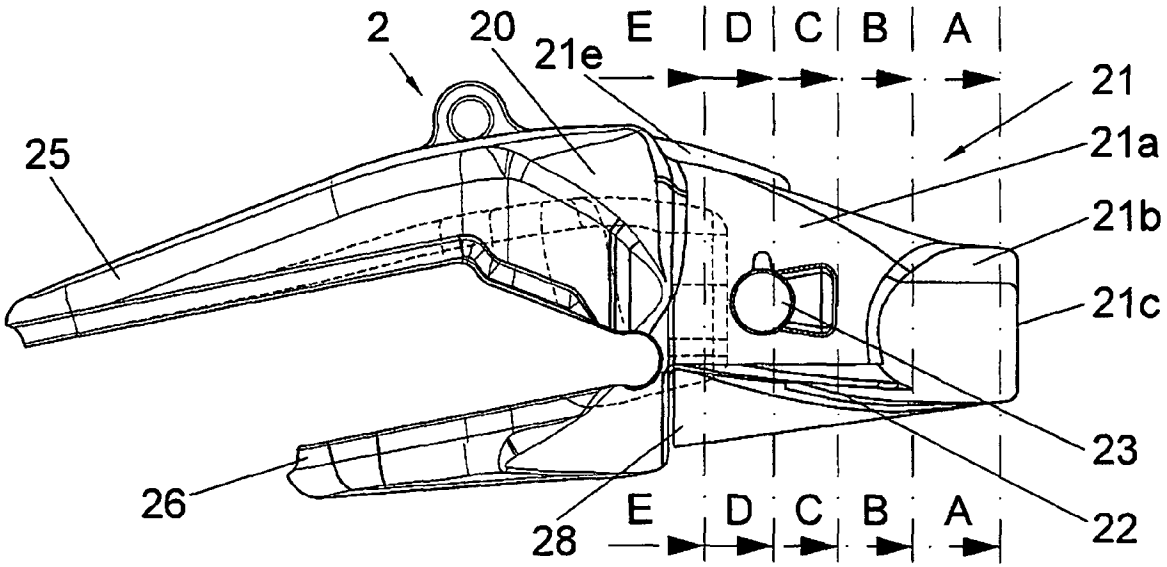
FIG. 3 shows a side elevational view of the tooth bar of FIG. 1.
Figures 3A, 3B, 3C, 3D, 3E:
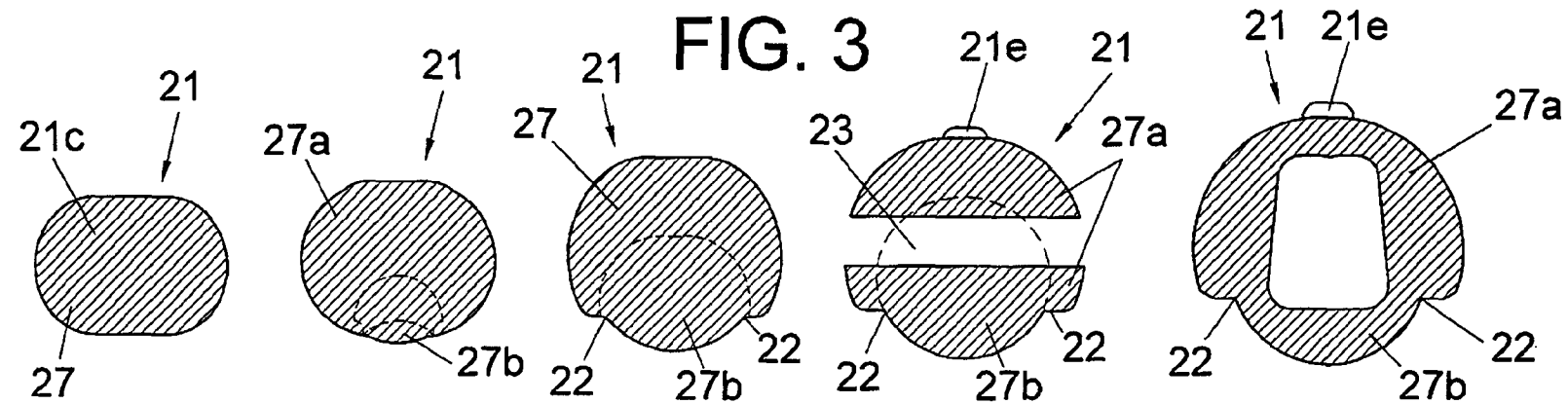
FIGS. 3*a*-3*e* show cross sectional views taken respectively along lines A-A-E-E of FIG. 3.

The wear assembly object of the present invention is made up of a wear member or tooth 1, an adaptor member or tooth bar 2 and a pin 3, 6, which is housed in an opening 23, either a through opening or not, of the tooth bar 2 and coinciding with the at least one through opening 13 of the tooth 1.

The tooth bar 2 applicable to a machine for moving materials such as earth and stones according to the present invention comprises a body 20 and a projecting area or nose 21, preferably symmetrical with respect to the vertical axis of the coupling or wear assembly, projecting from the front portion to be housed in a hollow, cavity or open box 11 of the tooth, and at least one passage 23, preferably a through passage, for the housing of a pin. Said body 20 of the tooth bar 2 has fixing means 25, 26 in its lower portion for its more or less permanent fixing to the blade of the bucket of a machine for moving earth and the like.

Said nose 21 of the tooth bar 2 has a proximal portion 21*d* of decreasing cross section ending in a distal portion 21*b* of continuous cross section, said decreasing section being formed by two decreasing superimposed sections 27*a*, 27*b*, one 27*a* having a larger surface than the other one 27*b*, coinciding in size and shape in the distal portion 21*b* of the nose 21 and preferably projecting in the proximal portion 21*d* of the smaller surfaced section 27*b* at the lower portion of the larger surfaced section 27*a*, such that along the length of the hollow 11 of the tooth existing between the mouth portion 11*a* and the back portion 11*c*, the smaller surfaced section 27*b*, preferably projecting at the lower portion of the larger surfaced section 27*a*, is progressively introduced into the larger surfaced section 27*a* until forming a single continuous cross section 21*b*. When the smaller surfaced section 27*b* projects from the larger surfaced section 27*a*, both superimposing one another, two union areas 22 are created, although only one could also be created, which define respective interlocking surfaces 22. The series of said sections therefore constitutes two bodies of revolution, preferably with a half-cone shape, along the union area with a preferably oval shape, a preferably larger upper one 21*a* and another preferably smaller lower one 28. The union of said bodies is what gives rise to said interlocking surfaces 22.

Figure 4:
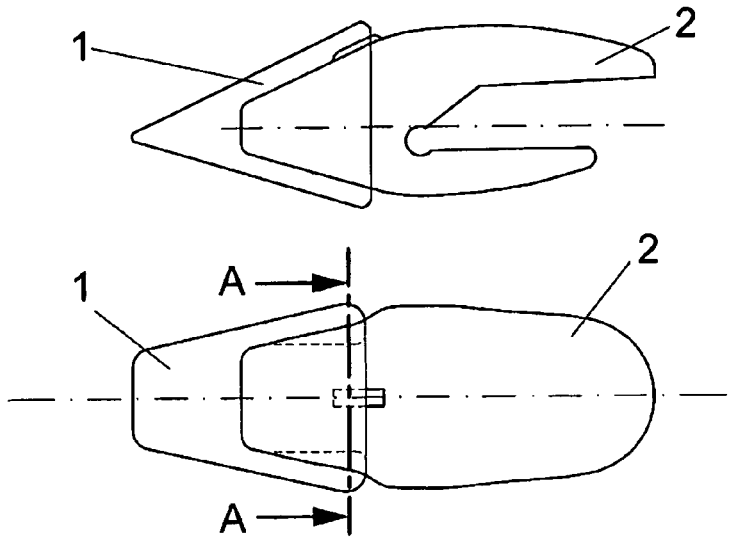
FIG. 4 represents a side and top schematic view of an interlocking between an adaptor member and a wear member, forming a wear assembly.
Figure 4A:
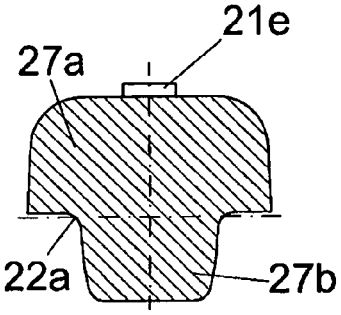
FIGS. 4*a*-4*e* show cross sectional views taken respectively along line A-A, which represent different alternatives of the interlocking surfaces generated in the tooth bar.
Figure 4B:
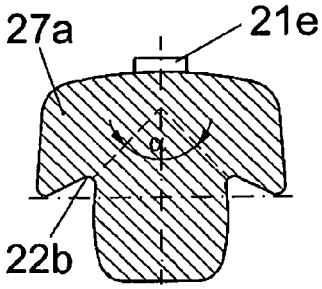
Figure 4C:
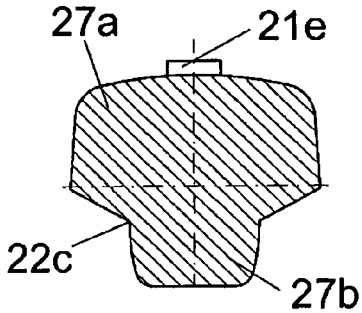
Figure 4D:
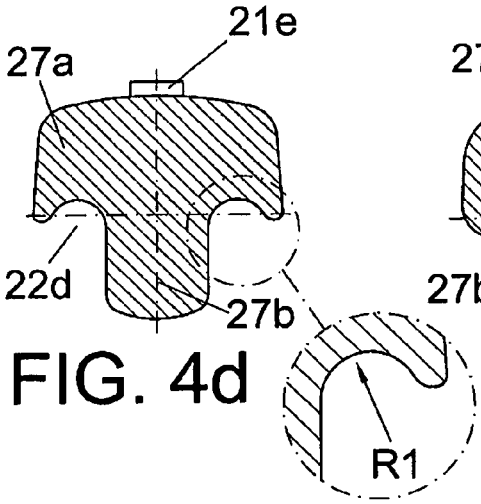
Figure 4E:
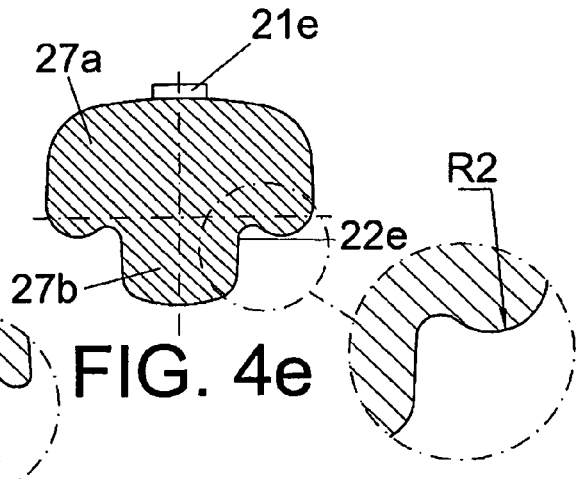
Figure 5:
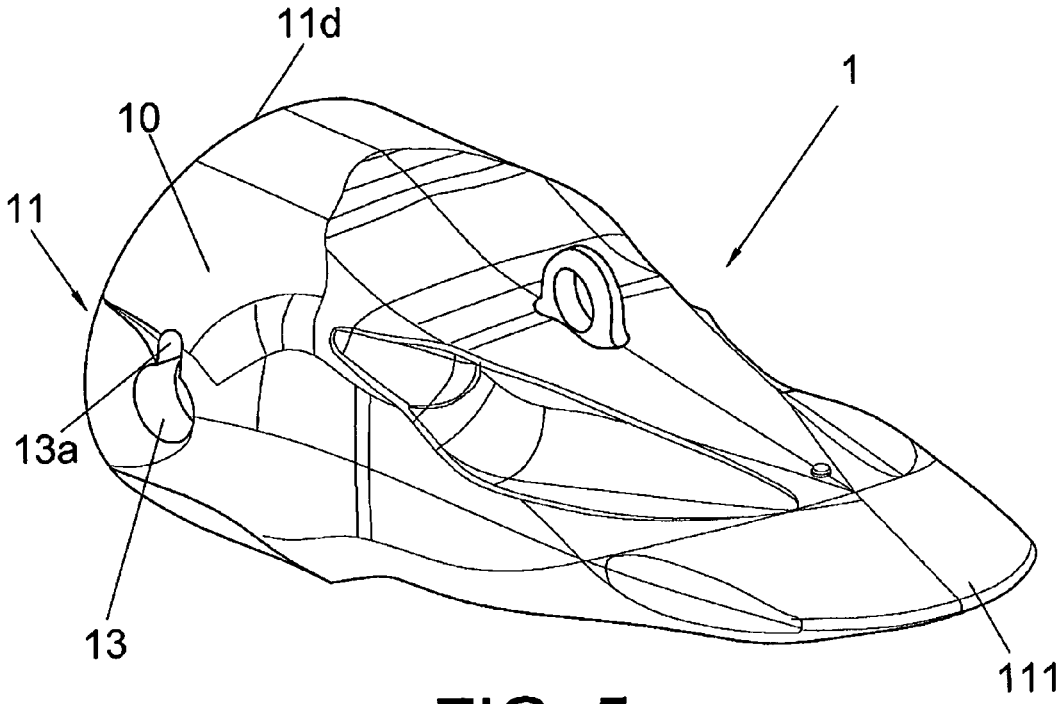
FIG. 5 shows a perspective view of a wear member or tooth.
Figure 6:
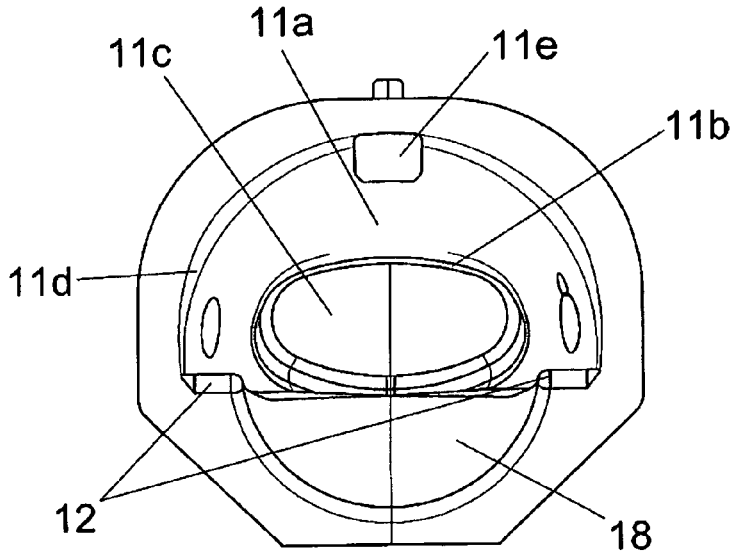
FIG. 6 shows a view of the hollow, cavity or box of the tooth of FIG. 5.
Figure 6A:
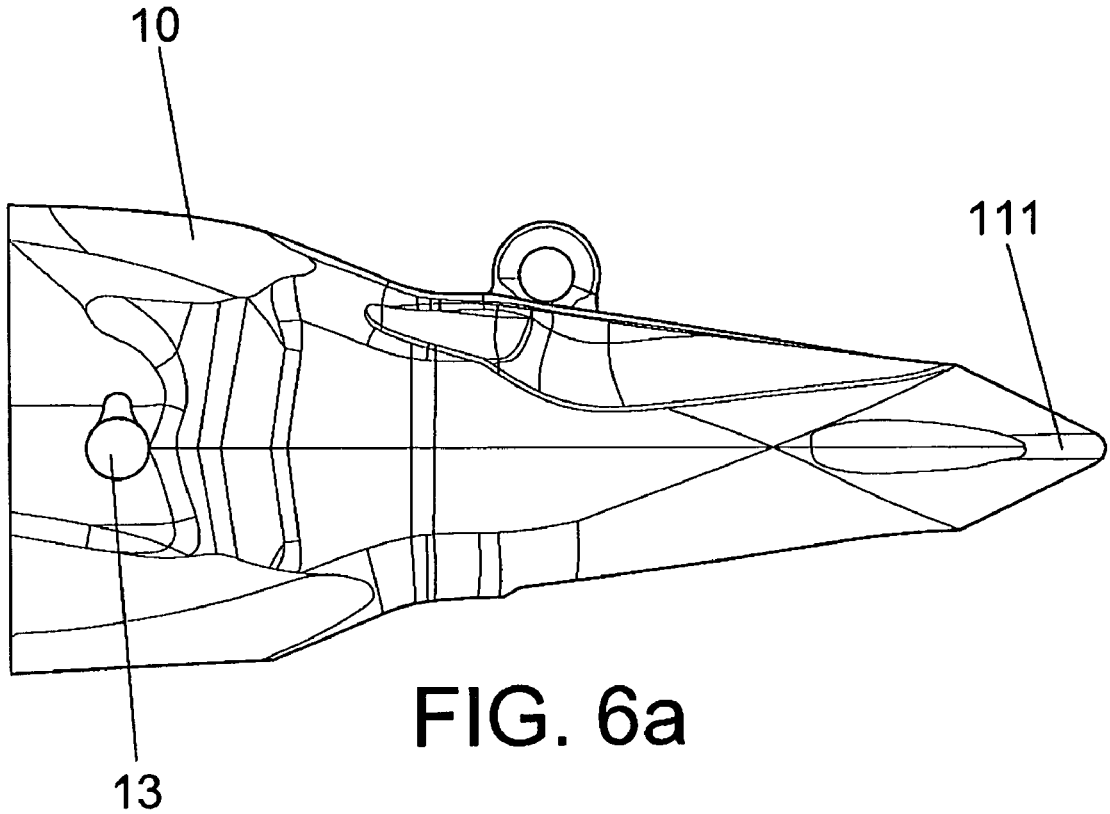
FIG. 6*a* shows a side view of the tooth of FIG. 5.
Figure 7:
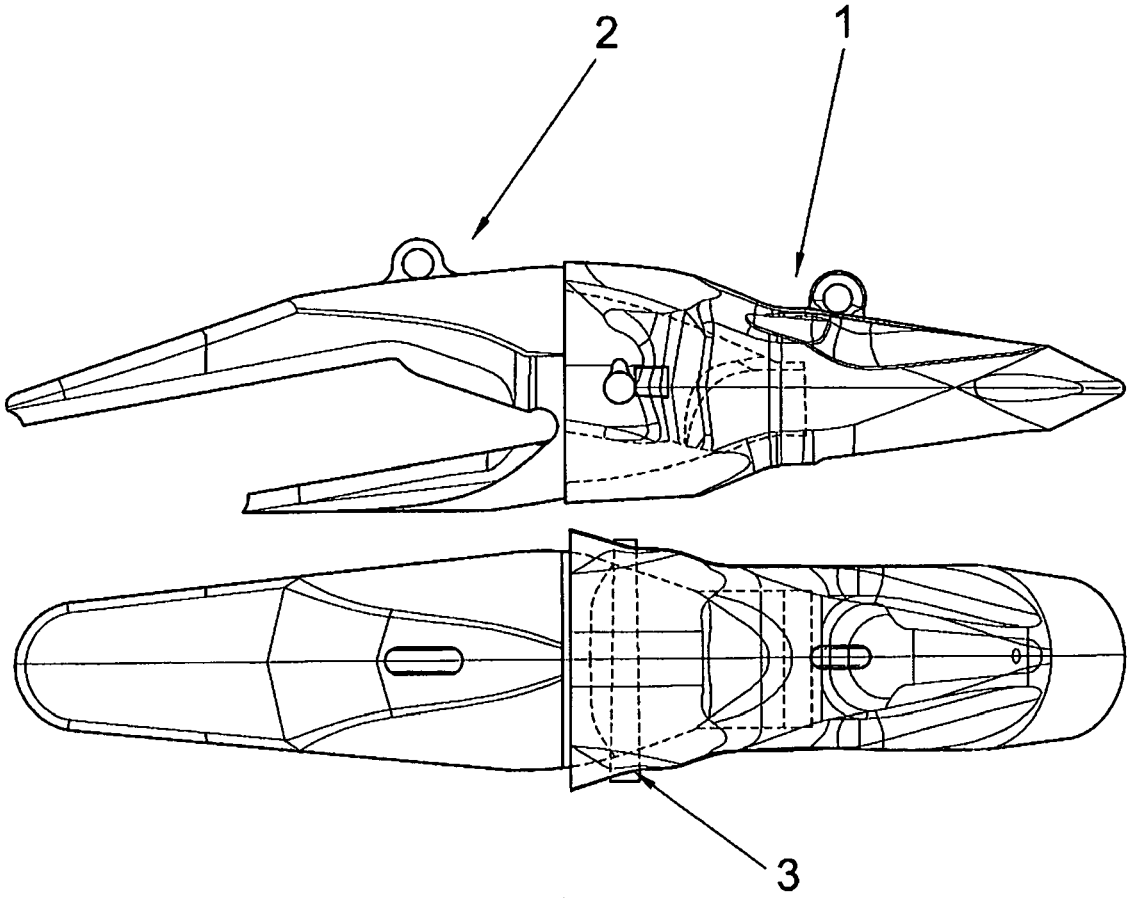
FIG. 7 shows and upper view and a side view of the wear assembly formed by a tooth and tooth bar.
Figure 7A:
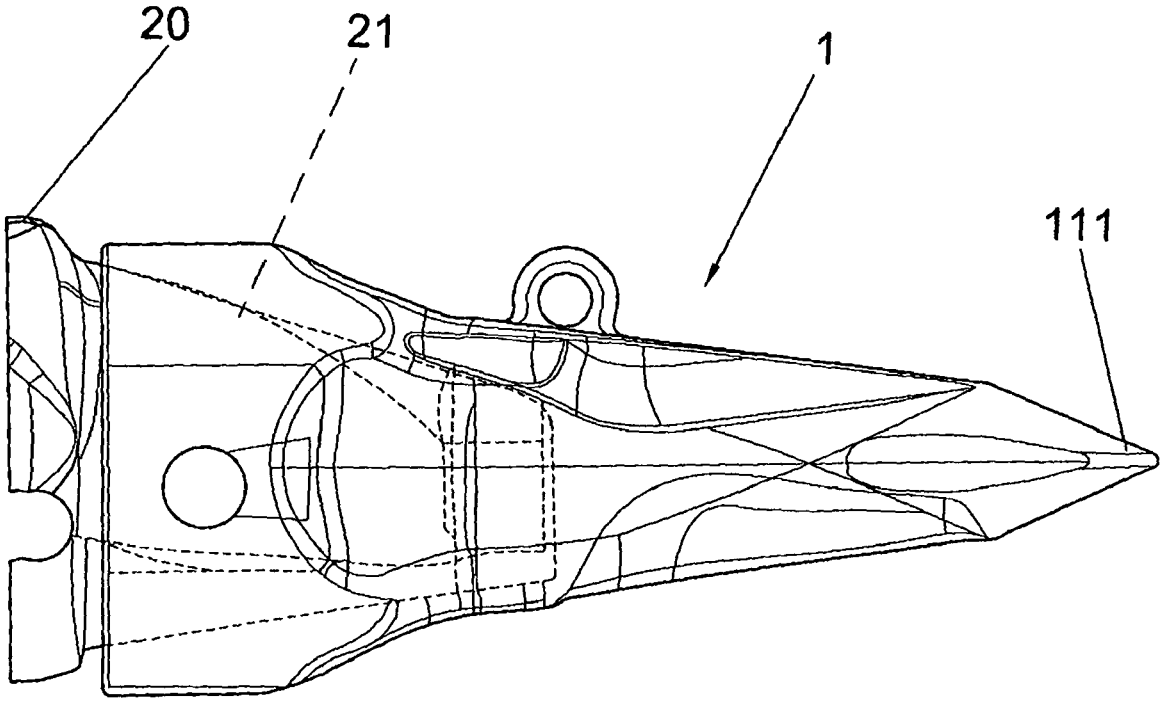
FIG. 7*a* shows a tooth and the nose of a tooth bar in working position.
Figure 7B:
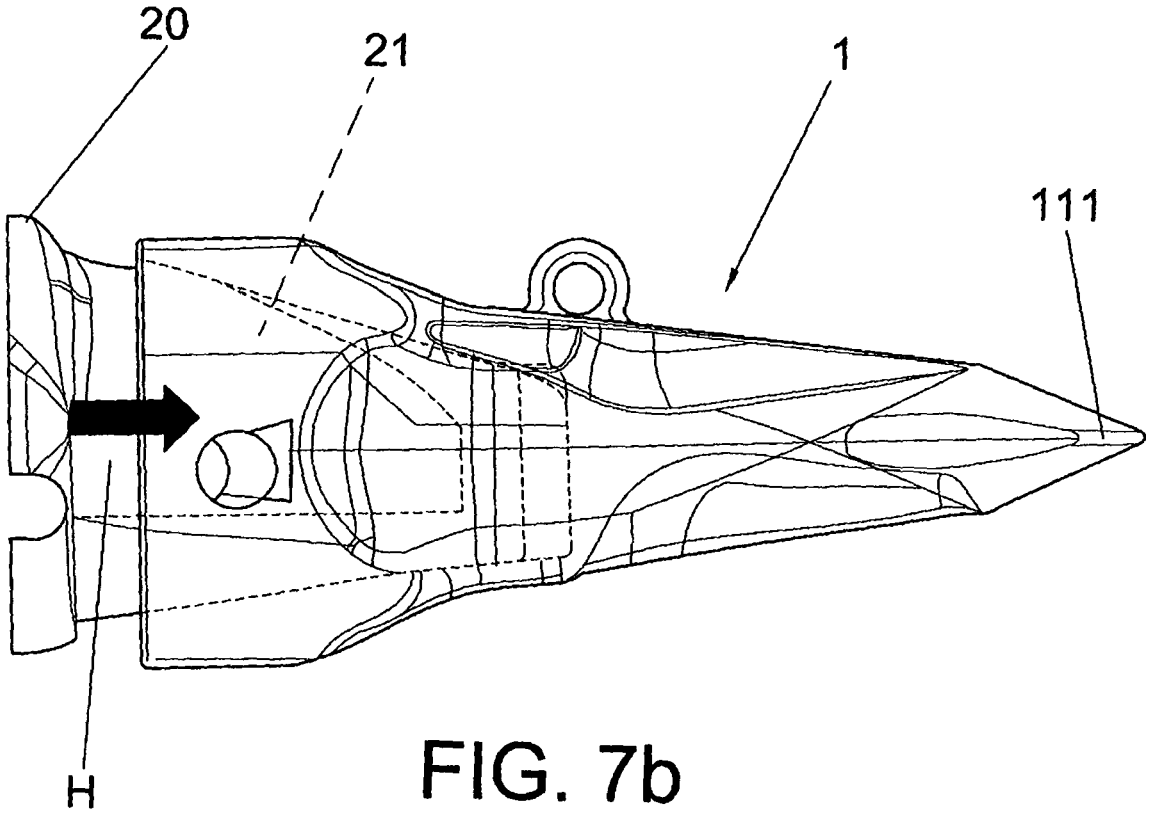
FIG. 7*b* shows the nose of a tooth bar and a tooth which cannot be decoupled when trying to extract the tooth according to a horizontal force H.
Figure 8:
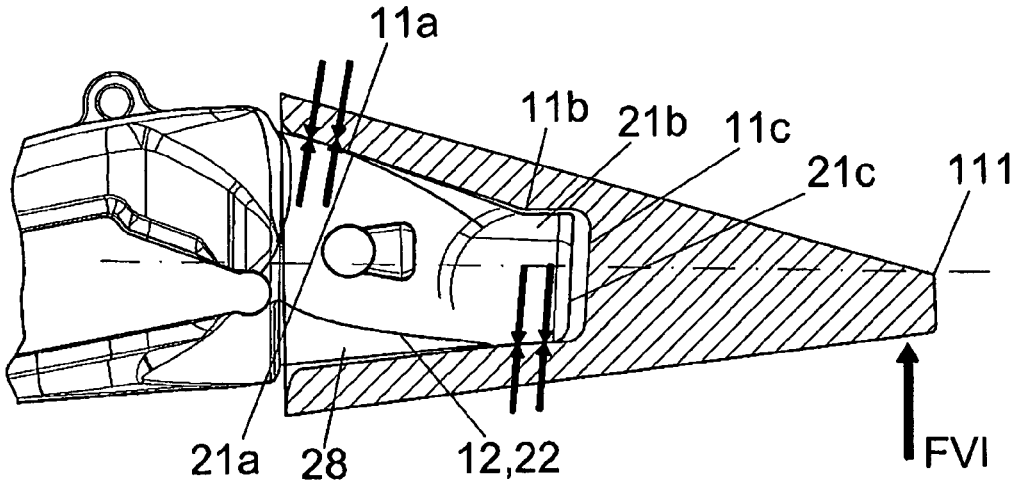
FIG. 8 represents a section of a wear assembly, tooth-tooth bar, object of the present application in which the reactions on the contact surfaces between tooth and tooth bar to a given upward vertical force are observed.

The profile of said interlocking areas can be modified according to the size or application of the tooth-tooth bar assembly, as can be observed in FIGS. 4 to 4*e*. In FIG. 4*a*, a straight Interlocking surface 22*a* is observed, defined by the union of sections 27*a* with sections 27*b* by means of a rectilinear line forming an angle of 0 degrees with the axis of symmetry of the wear assembly. The series of these lines is what determines the straight plane constituting the interlocking surfaces 22. In FIG. 4*b*, an interlocking surface is observed in which the upper surface 27*a* forms an acute angle with the lower surface 27*b*, thus creating an angle α between the two inclined interlocking surfaces. Also in FIG. 4*c*, rather than being acute, said angle of inclination is obtuse. The inclination for the two interlocking surfaces will mainly be determined by the required penetration and taking into account that a greater penetration requires less taper, it is estimated that the inclination of said planes with respect to the vertical axis of symmetry must be between 0 and 60 degrees, and to achieve an equilibrium between the penetration and robustness, said inclination must preferably be between 10 and 20 degrees.

In FIG. 4*d*, the union profile between the upper surface 27*a* and the lower surface 27*b* is convex with a curvature determined by a radius R1, such that the sections are joined by means of a curvilinear line, which will define curved interlocking surfaces. In FIG. 4, the profile is concave with radius R2.

By means of the embodiments shown in FIGS. 4*b* and 4*d*, formation of acute angle α between the extensions towards the upper or lower portion of the nose or hollow of the two interlocking surfaces 22*b* and curved interlocking surfaces 22*d* with radius R1 allows the tooth and tooth bar to self-tighten with one another in addition to achieving the offsetting of the expulsion force of the tooth upon applying a downward vertical force, achieving a retention effect not achieved by other systems The tooth 1 comprises a body 10 having a cavity, empty box or hollow 11 preferably symmetrical with respect to the vertical axis in the rear portion thereof for receiving a projection area or nose 21 projecting from a front portion of the body 20 of the tooth bar 2, and at least one through opening 13 communicating said hollow 11 of the tooth 1 with the outside, susceptible to collaborating with the passage 23 existing through said nose 21 of the tooth bar 2 to form together a passage for a pin 3, 6 when tooth and tooth bar 1, 2 are mutually coupled.

The symmetry with respect to the vertical axis in the body of the nose 21 of the tooth bar 2 and in the hollow 11 of the tooth 1, i.e. the symmetry of the coupling, allows a simpler manufacture of the tooth-tooth bar interlocking, as well as a better distribution of the stresses when the system is working.

The hollow 11 of the tooth 1 has its surfaces conjugated with those of the nose 21 of the tooth bar 2, such that a mouth portion 11*d* of decreasing cross section ending in a back portion 11*b* of continuous cross section, said decreasing section being formed by two superimposed decreasing sections, one of a larger surface than the other one, coinciding in size and shape in the back portion 11*b* of the hollow and in the mouth portion 11*b* the smaller surfaced section projects at the lower portion of the larger surfaced section, such that along the length 11*a* of the hollow existing between the mouth portion 11*d* and the back portion 11*c*, the smaller surfaced section projecting at the lower portion of the section of larger surface is progressively introduced into the larger surfaced section until forming a single continuous cross section. As in the nose 21 of the tooth bar 2, interlocking surfaces 12 complementary to those of the nose 21 of said tooth bar 2 are generated between said sections.

To carry out the coupling between the previously described tooth 1 and tooth bar 2 and to create the coupling system, as previously discussed the hollow 11 of the tooth 1 comprises a mouth portion 11*d* of decreasing cross section preferably substantially oval or elliptical shaped ending in a back portion 11*b* of continuous cross section and preferably substantially oval or elliptical shaped. Said mouth and back portions 11*d*, 11*b* of the hollow 11 of the tooth 1 are adapted so as to respectively interlock on proximal 21*d* and distal 21*c* portions of a conjugated configuration of the projecting area or nose 21 of the tooth bar 2 and at least one interlocking surface 12 encompassing at least part of the mouth portion 11*a* is adapted so as to make contact with at least one interlocking surface 22 of conjugated configuration existing in the projecting area 21 of the tooth bar 2 when tooth and tooth bar 1, 2 are mutually coupled.

To introduce the nose 21 of the tooth bar 2 into the hollow 11 of the tooth 1, it is necessary to carry out a rectilinear movement to overcome the two areas in opposition, interlocking surfaces of the tooth 12 and of the tooth bar 22, characteristic of the coupling system and of the structure of the tooth 1 and tooth bar 2. During this curvilinear movement there must be slippage on the upper faces of the tooth 11*a* and of the tooth bar 21*a*, and when the opposing areas or interlocking surfaces 12, 22 are facing, the slope of these areas must be less than the incremental reduction of the section in the forward introduction movement. It is thus possible to obtain two bodies 1, 2 with a perfect male-female reproduction which, once interlocked, have opposing areas without a natural release.

In the case of teeth and tooth bars intended for being used in mining where the dimensions of these members make their handling very difficult, a guide 21*e* is arranged on the upper portion of the nose 21 of the tooth bar to facilitate the introduction of the tooth bar into the hollow 11 of the tooth, said hollow 11 having a groove or channel 11*e* complementary to the guide 21*e* of the tooth bar. Although not shown in the figures, it is evident that it is possible to arrange the guide in the hollow 11 of the tooth and the groove in the nose 21 of the tooth bar.

Once the tooth 1 is introduced in the tooth bar 2, when a normal force is applied in a longitudinal direction H, the tooth does not come out of the tooth bar since the two interlocking planes or surfaces 12 of the tooth 1 and of the tooth bar 2 are in opposition. It is necessary to apply a force with two components following the previously described curvilinear movement in order to extract the tooth.

Figure 9:
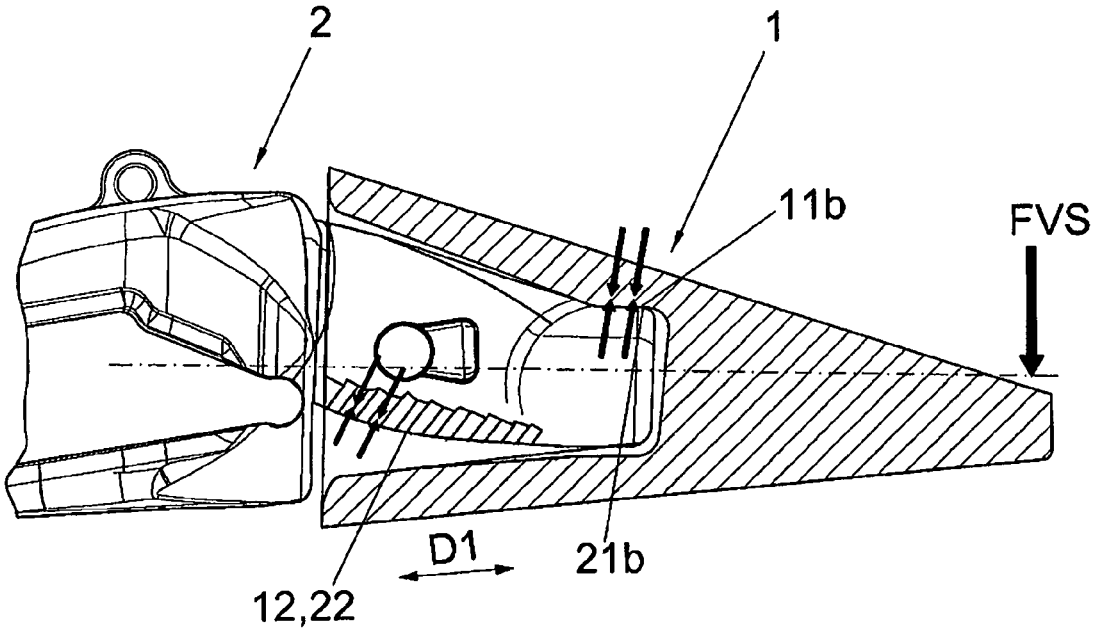
FIG. 9 represents a section of a wear assembly, tooth-tooth bar, object of the present application in which the reactions on the contact surfaces between tooth and tooth bar to a given downward vertical force are observed.
Figure 9A:
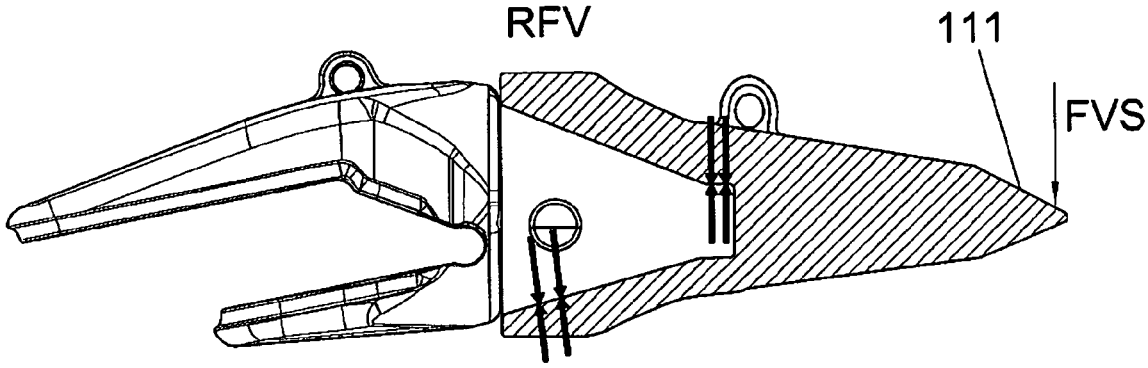
FIG. 9*a* represents a section of a traditional wear assembly, tooth-tooth bar, in which the reactions on the contact surfaces between tooth and tooth bar to a given downward vertical force are observed.
Figure 10:
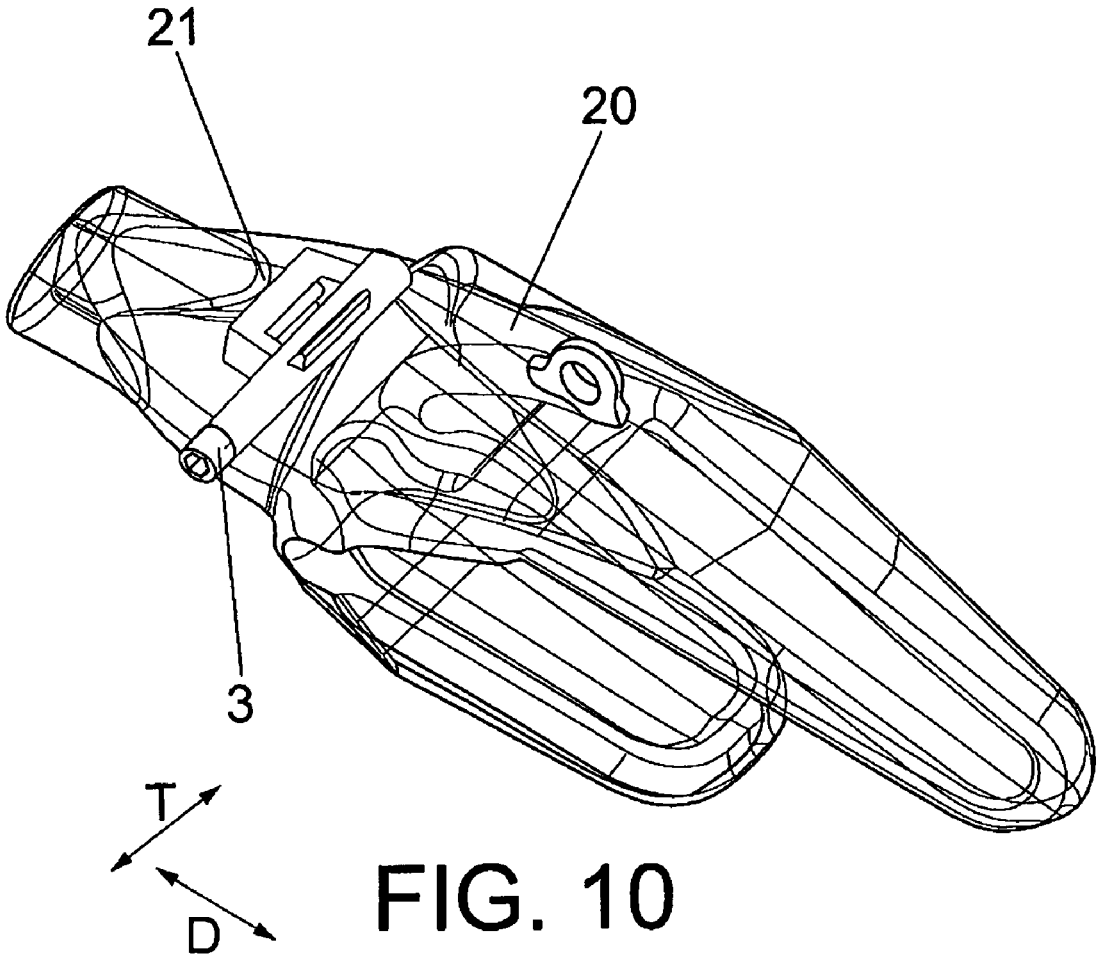
FIG. 10 shows a perspective view of a tooth bar with a first pin embodiment introduced in its housing, the retainer members of said pin in the tooth bar being visible.
Figure 11:
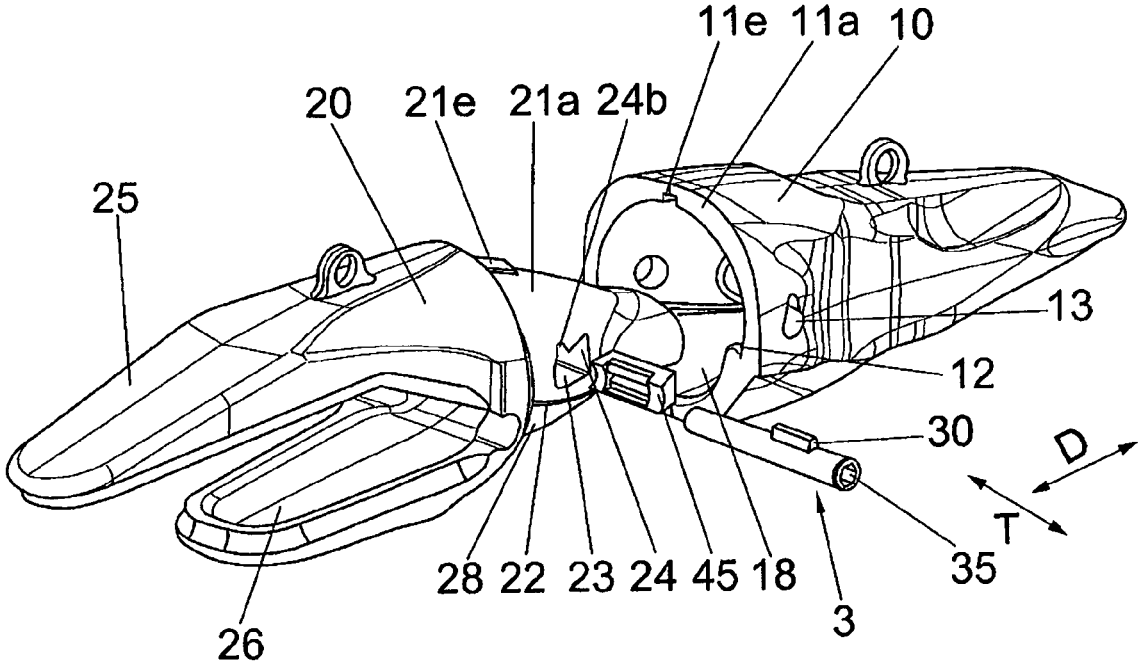
FIG. 11 shows an exploded rear perspective view of the assembly of two members together with a first pin embodiment, also object of this invention.
Figure 12:
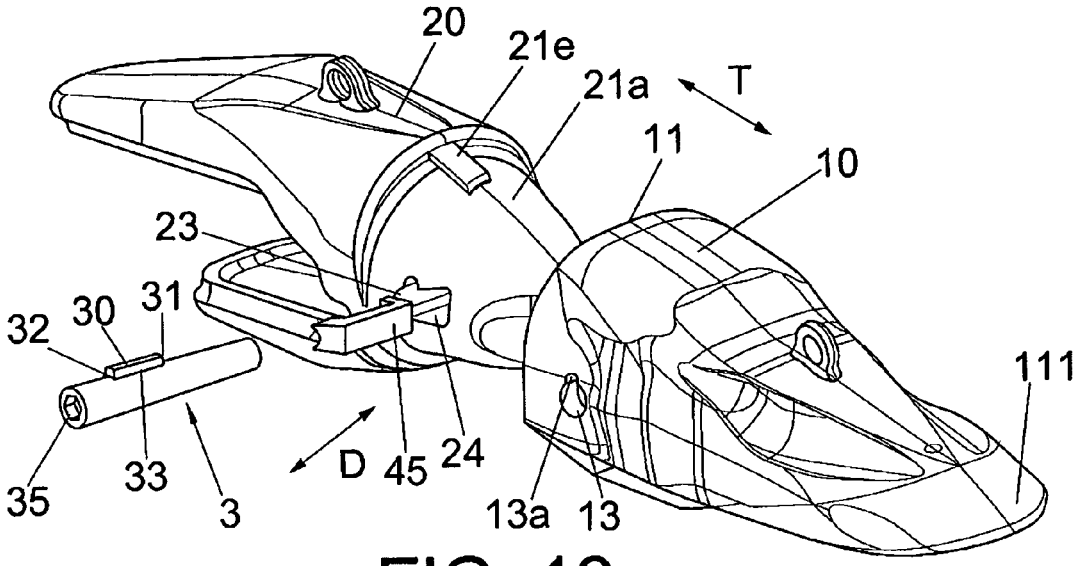
FIG. 12 shows an exploded front perspective view of the assembly of two members together with a first pin embodiment, also object of this invention.

The conjugated configurations of the respective interlocking surfaces 12, 22 allow that a force applied on the tip 111 of the tooth 1 in a downward transverse direction FVS, this being the normal work of the machines, creates a reaction between tooth 1 and tooth bar 2 in the interlocking surfaces 12, 22 which make both bodies self-tighten against one another, unlike what occurs in traditional couplings (FIG. 9*a*) in which the components of the reactions to said vertical force tend to separate the tooth from the tooth bar. The contact between the interlocking surfaces 12, 22 likewise prevents the tooth 1 from being extracted from the tooth bar 2 in a rectilinear longitudinal extraction direction.

The preferably oval-shaped configuration of the contact surfaces of the tooth 11*a* and of the tooth bar 21*a* allow that when a force is applied on the tip 111 of the tooth 1 in an upward transverse direction FVI, it creates reactions between tooth 1 and tooth bar 2 in said contact surfaces 11*a*, 21*a*.

Figure 29:
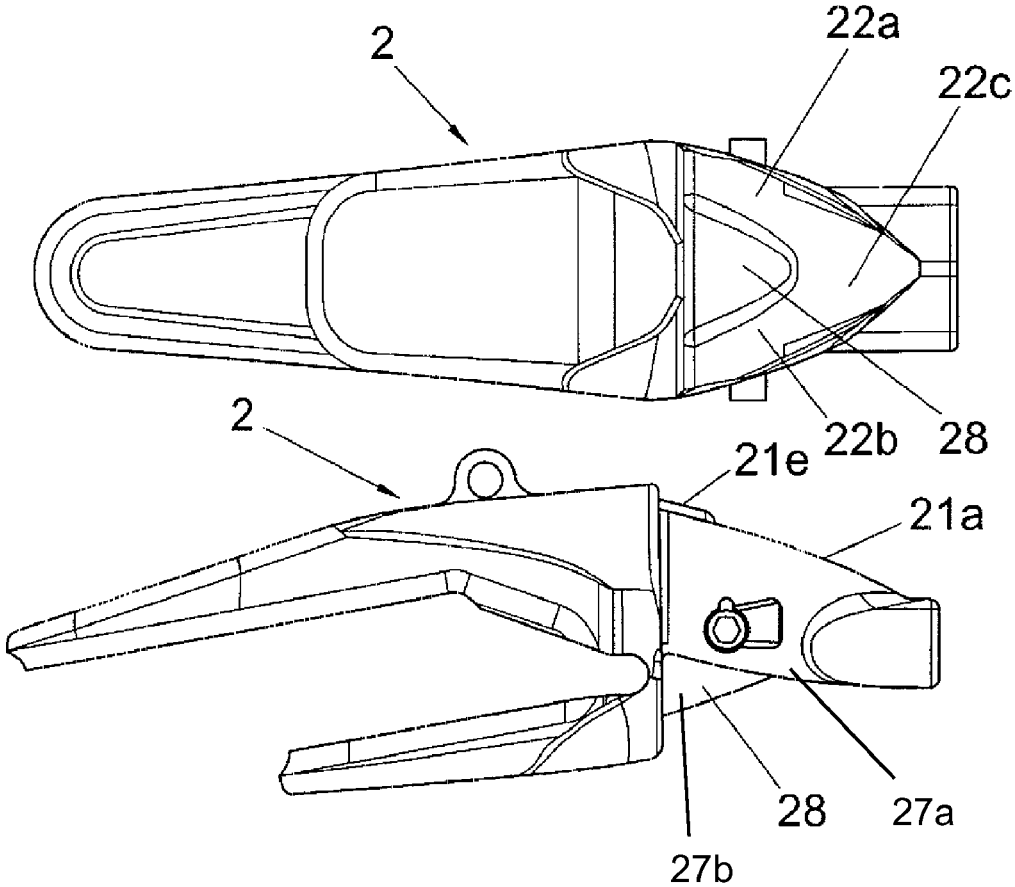
FIG. 29 shows an alternative configuration of the lower portion of a tooth bar in which the interlocking surfaces are observed.

The interlocking surfaces 22 can be of different dimensions according to the applications of the wear assembly, even being able to occupy the entire lower portion of the upper larger surfaced section 27*a*, thus almost completely eliminating the lower smaller surfaced section 27*b* except in the beginning of the mouth portion or proximal portion. FIG. 29 shows a tooth bar with two interlocking surfaces 22*a* and 22*b* joined at their front portion by a third surface 22*c*, said interlocking surfaces being constituted of a curved plane and the lower half-cone being formed by the lower smaller surfaced sections 27*b*, having less length than the proximal portion 21*a* of the nose. In this embodiment, it can be observed how the smaller surfaced section 27*b* is completely introduced into the larger surfaced section 27*a* at a point located between the beginning and the end of the proximal portion 21*a*.

To assure the coupling between the previously described tooth 1 and tooth bar 2, it is necessary to use a retention system which is introduced in the passage 23 of the tooth bar and openings 13 of the tooth.

A retention system suitable for the system object of the present invention due to its structure and operation comprises a pin 3, 6 with a preferably cone-shaped elongated body of revolution, although it may also be cylindrical; means allowing the rotation of said pin about its own axis 35, 65; guide members for the introduction of the pin in the wear assembly; and a retainer member acting perpendicularly to the axis of the pin. By means of the use of a retention system with these features the application and use of the tooth-tooth bar interlocking in mining is simplified, allowing carrying out the tooth replacement action more safely as having to use large mallets is prevented.

It is evident that the tooth-tooth bar wear assembly can be provided with more than one retention system, arranged in vertical or horizontal position, each retention system further being able to have more than one retainer member.

In view of the foregoing and making reference to FIGS. 10 to 15 below according to another aspect of the present invention, the application of a retention system with said features to a tooth 1 and tooth bar 2 interlocking such as that previously described is considered.

The body 10 of the tooth 1 comprises at least one through opening 13, and preferably two mutually facing opening located on the sides of said hollow 11, and the tooth bar 2 comprises a preferably through hole 23 preferably located in the nose 21 such that when tooth and tooth bar 1, 2 are mutually coupled, said two through openings 13 are coaxially aligned and connected to ends of said through hole 23, together defining a passage for a pin 3. When said pin 3, which is of an elongated and preferably cone-shaped configuration, is completely introduced into the passage, it has end areas located in the respective through openings 13 of the tooth 1 and a mid area located in the through hole 23 of the tooth bar 2, locking the decoupling possibility of the tooth and tooth bar 1, 2. In the embodiment shown in FIGS. 10 to 15, said passage is arranged in a transverse direction T substantially perpendicular to the longitudinal direction D and substantially parallel to said blade.

Said pin 3 has a general cone-shaped outer surface arranged between two bases and when it is completely introduced in the passage, it can rotate therein between an initial angular position and a final angular position. The catch 30 has a first end 31, a second end 32 and an edge 33, and it is arranged in a generating direction on said cone-shaped outer surface of the pin 3 and preferably in a middle area thereof. The pin 3 includes a single grip configuration 35 at one of its bases or a grip configuration 35 at one of its bases and another grip configuration located at the other one of its opposite bases. The grip configurations 35 are identical or different and in any case suitable for being coupled by a working tip of a tool. The grip configuration 35 preferably comprises a cavity of polygonal, for example hexagonal or square, cross section suitable for being coupled by a working tip of a tool in conjugated polygonal prism shape.

Adjacent to the through hole 23 in the nose 21 of the tooth bar 2 and communicated therewith there is arranged a housing 24 open at one of the side walls of the nose 21 next to the mouth of the through hole 23 for receiving retention means 4 made up of a rotation retainer 40 which collaborates with said catch 30 so as to releasably lock the rotation of the pin 3 in said final angular position, and an axial decoupling retainer 45 collaborating with the catch 30 to retain the pin 3 completely introduced in the passage when the pin 3 is retained in the final angular position. The housing 24 has a blind bottom 24*a* and an opening 13, of said two through openings 13 of the tooth 1 (specifically, opening 13 of the side opposite to the blind bottom of the housing 24), in includes next to its edge a through notch 13*a* which, when the tooth and tooth bar 1, 2 are mutually coupled, is aligned with a groove 24*b* which is adjacent to and communicated with the through hole 23 of the tooth bar 2. The groove 24*b* ends at the height of the blind bottom of the housing 24, facing a cavity of the housing 24. When tooth and tooth bar 1, 2 are mutually coupled, this notch 13*a* and this groove 24*b* allow the passage of the catch 30 when the pin 3 is inserted in the passage until said first end 31 thereof abuts with an end of the groove 13*a*, position in which the pin 3 is completely introduced in the passage. From this position, the cavity of the housing 24 allows the rotation of the catch 30 from the initial angular position to the final angular position.

Figure 13:
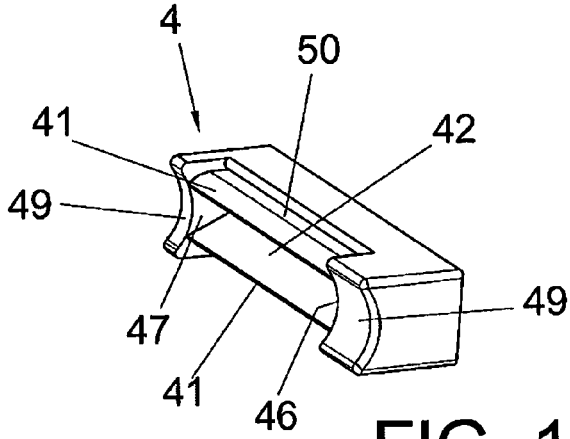
FIG. 13 shows a perspective view of the retention means of the assembly of FIGS. 10, 11 and 12.
Figure 13B:
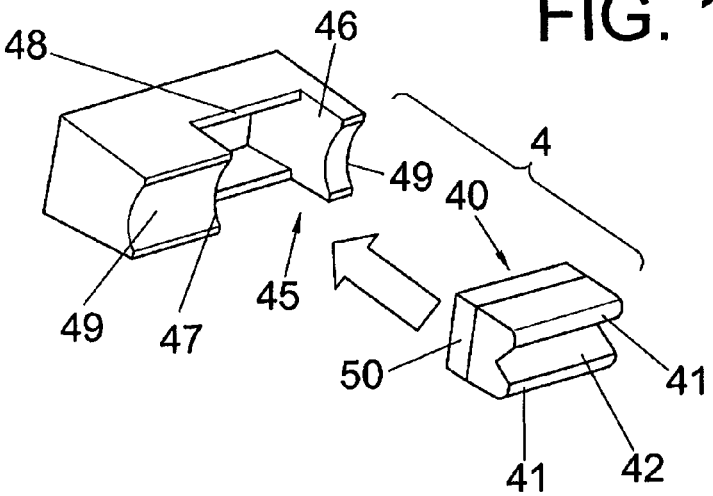
FIG. 13*b* shows an exploded view of the elements making up the retention means shown in FIG. 13.

As is shown better in FIGS. 13 and 13*b*, the rotation retainer 40 comprises a body with two mutually parallel ridges 41 between which a groove 42 is defined. Said body of the rotation retainer 40 is connected to resilient means 50 and when the retainer is in operative position, it is arranged with a groove 42 oriented in the axial direction of the passage and facing it, and with said ridges 41 in the rotational path of the catch 30, which allows it to receive said edge 33 of the catch 30 in the groove 42 due to the momentary deformation of said resilient means 50 when the pin 3 is rotated to its final angular position. For its part, the axial displacement retainer 45 comprises a body with first and second side surfaces 46, 47 located transversely at the ends of said ridges and groove 41, 42 in order to abut with said first and second axial ends 31, 32 of the catch 30 when the pin 3 is at least in its final angular position. Said body of the axial displacement retainer 45 defines between said first and second side surfaces 46, 47 a cup for receiving an inserted block of elastomeric material constituting said resilient means 50 of the rotation retainer 40. Said block of elastomeric material is joined to a face of the body of the rotation retainer 40 opposite to the ridges and groove 41, 42 and is of a trapezium section, with its wider base farther from the body of the rotation retainer 40, which facilitates its fixing to the inside of said cup by simple pressure. The body of the axial displacement retainer 45 further defines concave surfaces 49 on both sides of the first and second side surfaces 46, 47 which also cooperate with the through hole 23 of the tooth bar 2 to define the passage in some of the portions where the through hole 23 is communicated with the housing 24.

Once the rotation and axial displacement retainers are assembled as shown in FIG. 13, they form a single part susceptible to being introduced by sliding into the housing 24 existing in the nose 21 of the tooth bar. The body of the axial displacement retainer 45 is of a trapezium cross section, with its widest base farther from said concave surfaces, and the housing 24 has a conjugated trapezium cross section with its widest based farther from the passage so as to receive and retain in a radial position adapted to the body of the axial displacement retainer 45 with the body of the rotation retainer 40 assembled thereto. The length of the body of the axial displacement retainer 45 is equal or slightly less than the depth of the housing 24, therefor its axial position is determined by the contact of the end of the body of the axial displacement retainer 45 with said blind bottom of the housing 24, The side of the box 11 of the tooth 11 around the through opening 13 obstructs the housing 24 of the tooth bar 2 when tooth and tooth bar 1, 2 are mutually coupled, the opening of the housing 24 of the tooth bar 2 trapping therein the rotation retainer 40 and the axial displacement retainer 45 of the retention means 4 located in its correct position.

Figure 14:
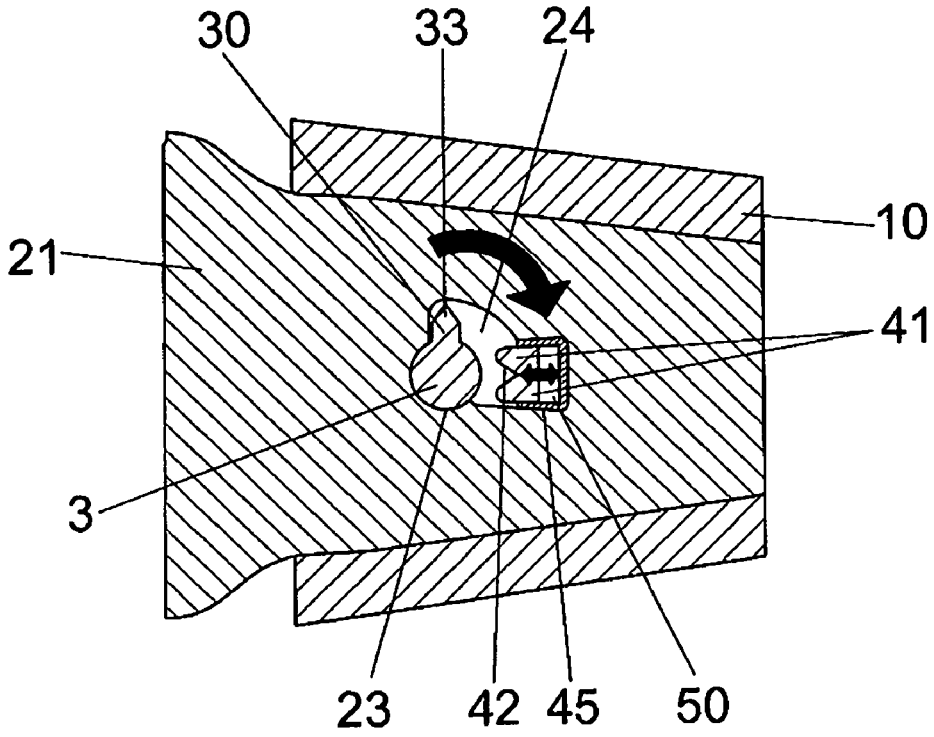
FIGS. 14 and 15 show cross sectional views showing the pin and retention means in the initial and final angular positions of the pin, respectively.
Figure 15:
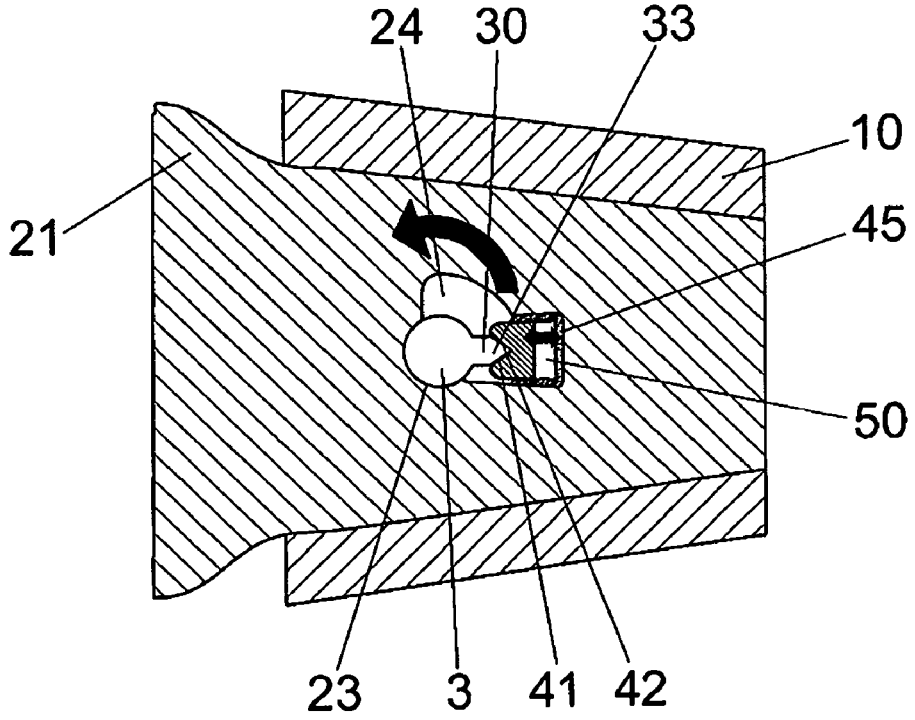

FIGS. 14 and 15 show the operation of the rotation retainer 40 in cooperation with the catch 30 of the pin 3. In FIG. 14, the pin 3 is in its initial angular position, i.e. in the angular position at which it is initially introduced in the passage. In FIG. 15, the pin has been rotated about 90° to its final position in which the edge 33 of the catch 30 has been trapped by the groove 42 of the rotation retainer 40 by momentary deformation of the resilient means 50 forced by the flanks of the edge 33 on the corresponding ridge 41.

In another example of use of said retention system, not shown in the figures, it comprises two through openings in the upper and lower walls of the hollow of the tooth 1, whereas in said projecting area or nose of the body of the second part, a hollow is located providing a vertical passage. That is, here the passage for the pin is defined through said upper and lower walls of the tooth, the transverse direction still being substantially perpendicular to the longitudinal direction but it is substantially perpendicular to said blade of the bucket of the machine. In reference to the configuration and arrangement of the retention means, this embodiment is similar to that described above with FIGS. 10 to 15, therefore its description will be omitted.

Described below in reference to FIGS. 16 to 22 is a second embodiment of a retention system according to the previously mentioned features applied to the tooth-tooth bar assembly object of the present invention.

Figure 16:
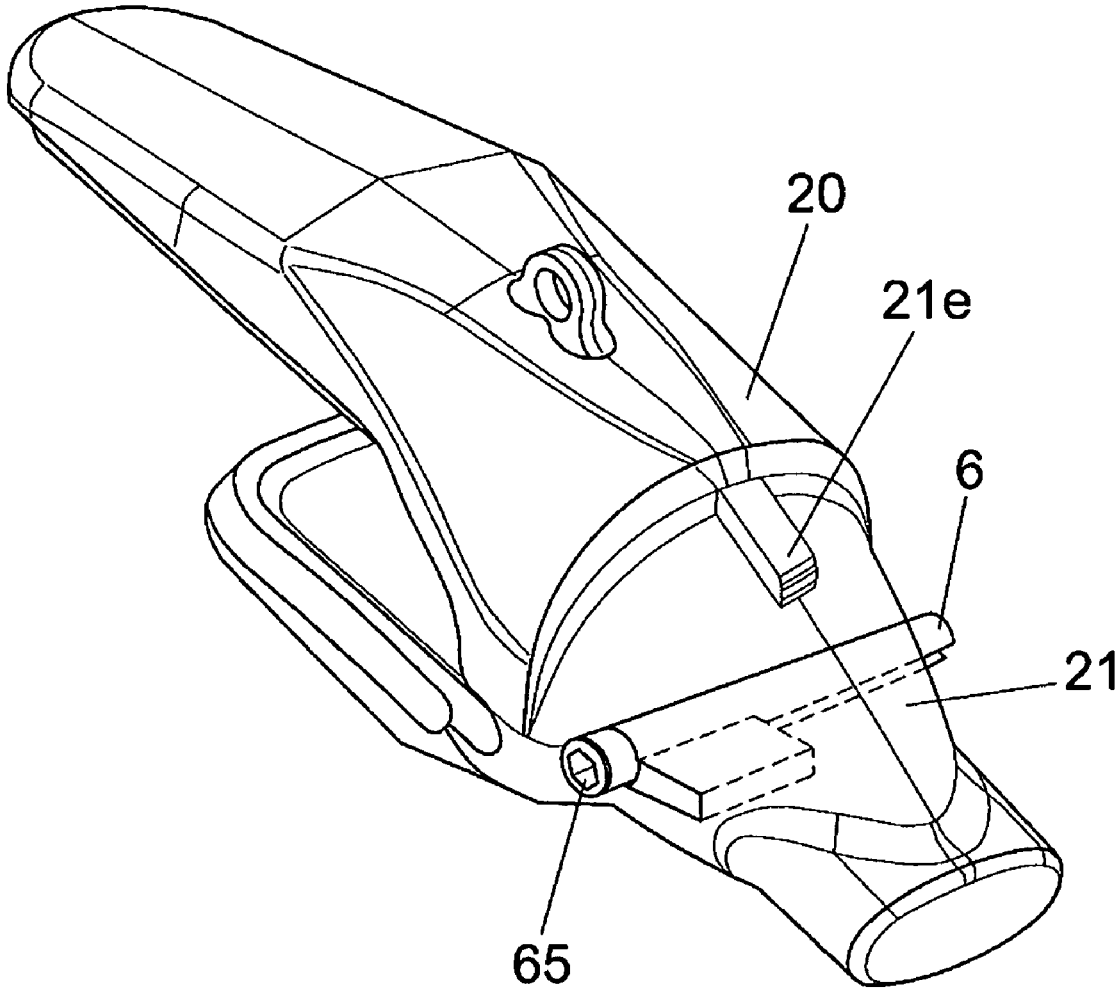
FIG. 16 shows a perspective view of a tooth bar with a second pin embodiment introduced in its housing, the retainer members of said pin in the tooth bar being visible.
Figure 17:
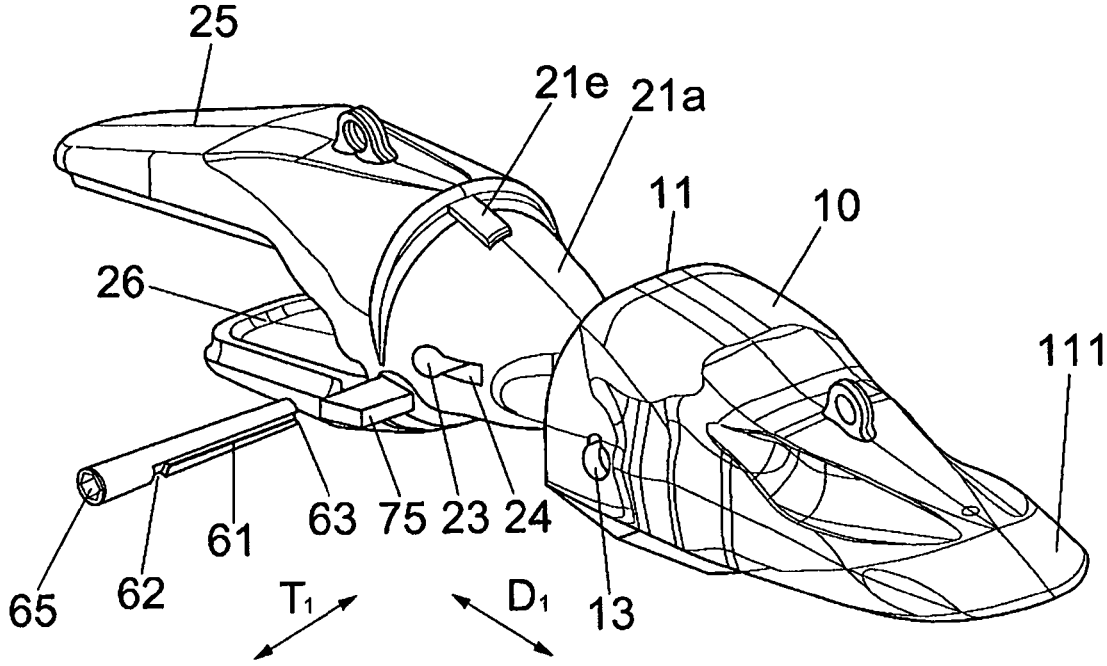
FIG. 17 shows an exploded front perspective view of the assembly of two members together with a second pin embodiment, also object of this invention.
Figure 18:
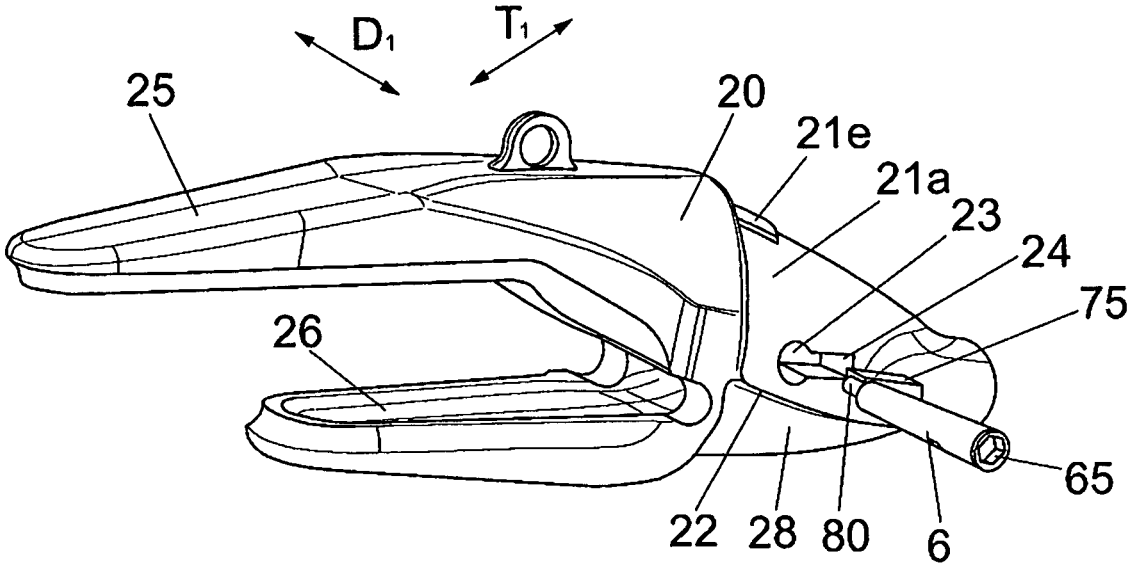
FIG. 18 shows an exploded rear perspective view of the tooth bar and the pin of FIG. 17.
Figure 19:
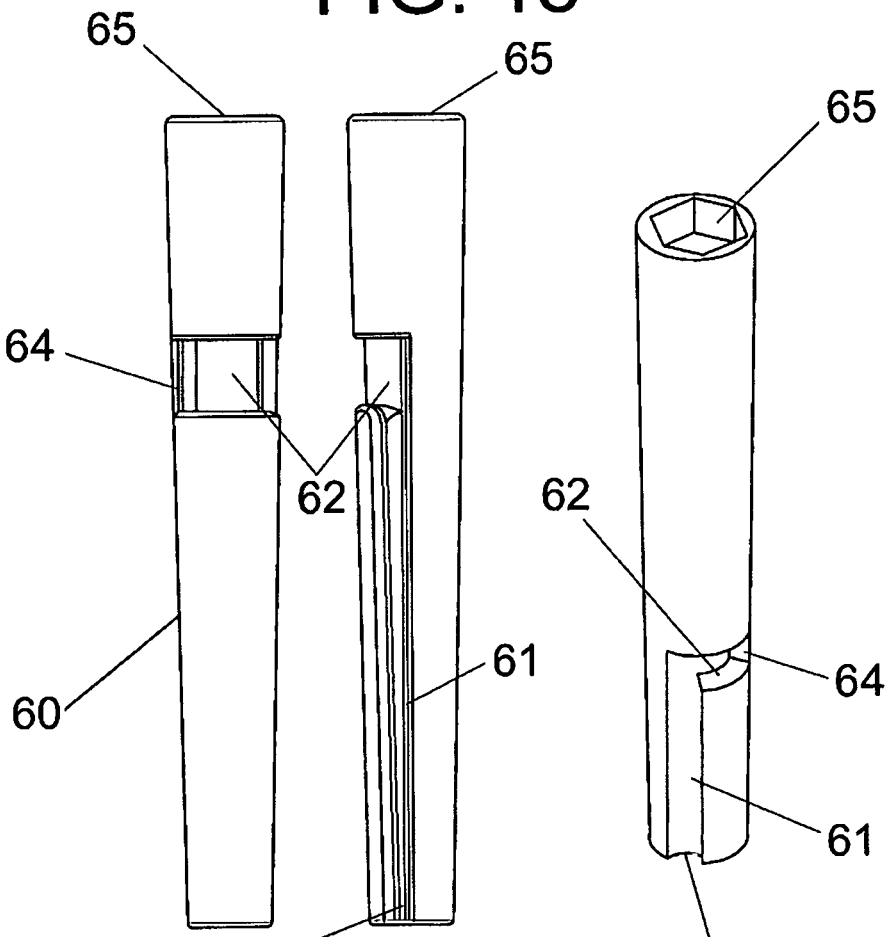
FIG. 19 shows a perspective view and two side views of the pin object of the second embodiment.
Figure 20:
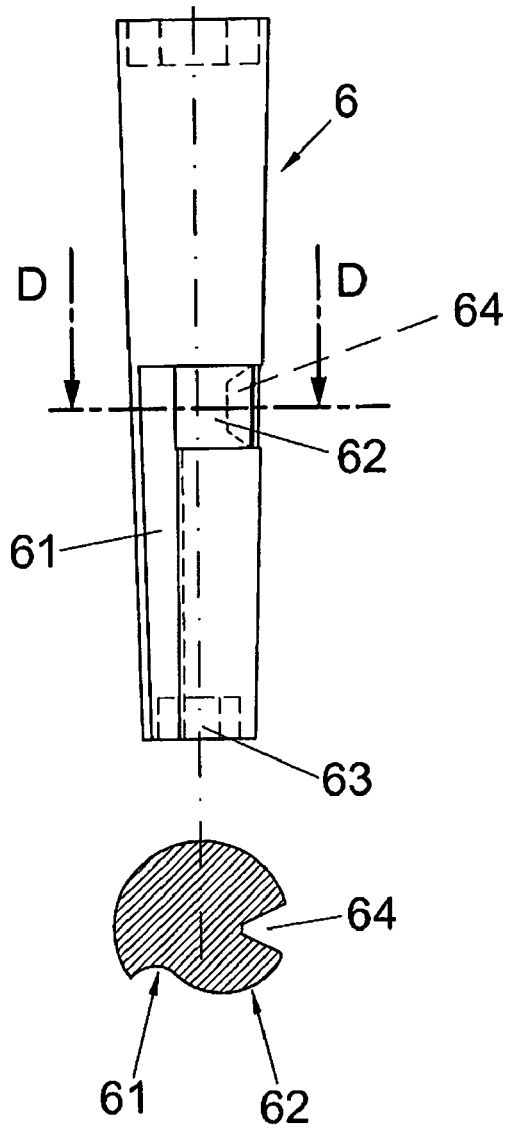
FIG. 20 shows a side and sectional view of the pin.
Figure 20A:
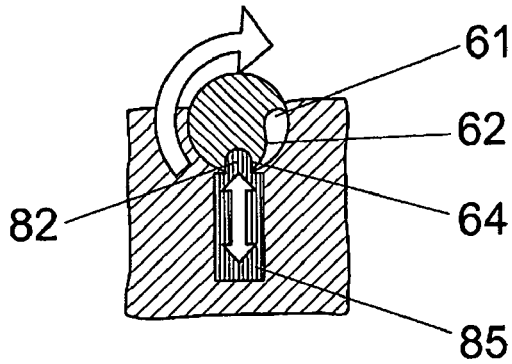
FIG. 20*a* shows a cross section in which the retention of the pin in the tooth bar as a result of the action of the retainer member is observed.

The pin 6, which is generally shown in FIGS. 16, 17 and 18, and more specifically in FIGS. 19 and 20, is of a preferably cone-shaped elongated configuration and arranged between two bases. When it is completely introduced in the passage, the pin 6 has end areas located in the respective end cone-shaped portions of the passage defined by the openings 13 of the tooth 1 and a middle area located in the middle portion of the passage defined by the passage 23 of the tooth bar 2.

In the embodiment shown, the pin 6 has guiding means constituted of a guide runner 61 arranged in a generating direction on said cone-shaped surface of the pin 6, with a first end 63 opening into one of said bases and a second end in a middle area of the pin 6. A locking runner 62 is arranged in a generally circumferential or slightly spiral direction on said cone-shaped surface 60 and has a first end 63 connected to said second end of the guide runner 61 and a second end 64 at a predetermined angle from the first one. Arranged in said second end 64 of the locking runner 62 is a cavity for receiving the retainer member 8. The retainer member 8 comprises a retractable lug adapted for sliding along said guide 61 and locking 62 runners and for being housed in said cavity of the pin. Said pin 6 also has means allowing the rotation about its own axis, such as the grip configurations 65, possibly being arranged at one or at both of the bases of the pin 6, depending on whether or not the pin is a through pin. If the pin were to have a single guide runner 61 and a single grip configuration 65, the latter would be located at the base opposite to the base in which said first end 63 of the guide runner 61 opens. In any case, the grip configuration 65 comprises a cavity of polygonal cross section (hexagonal in the illustrated example, although it could be square or of another section) suitable for being by a working tip of a tool in conjugated polygonal prism shape.

Said retractable lug 8 is formed in one end of a body 86, which includes resilient means 85 configured and arranged such that said retractable lug is susceptible to being retracted due to the action of a force applied on said retractable lug against the force of said resilient means 85.

Figure 22:
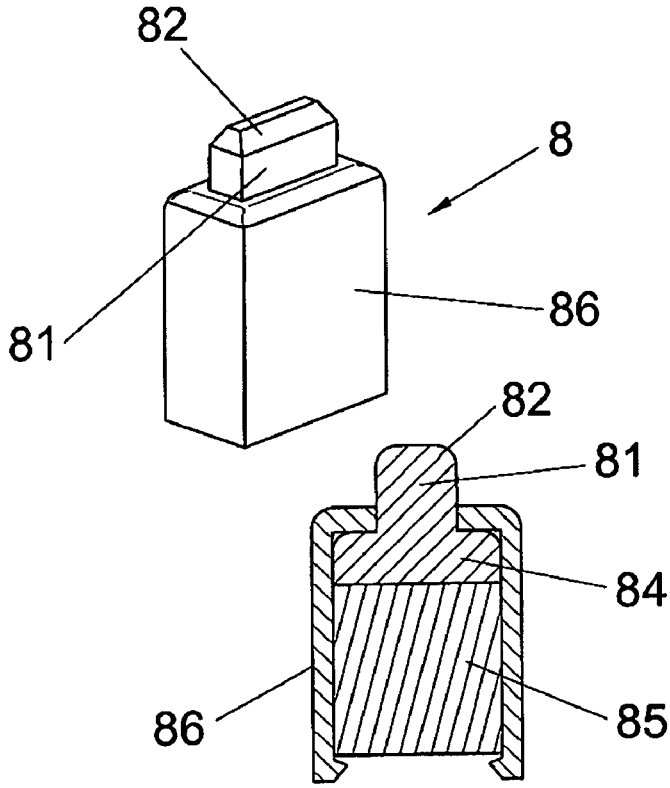
FIG. 22 shows a perspective and sectional view of another embodiment of the retainer device of the assembly of the invention.
Figure 23:
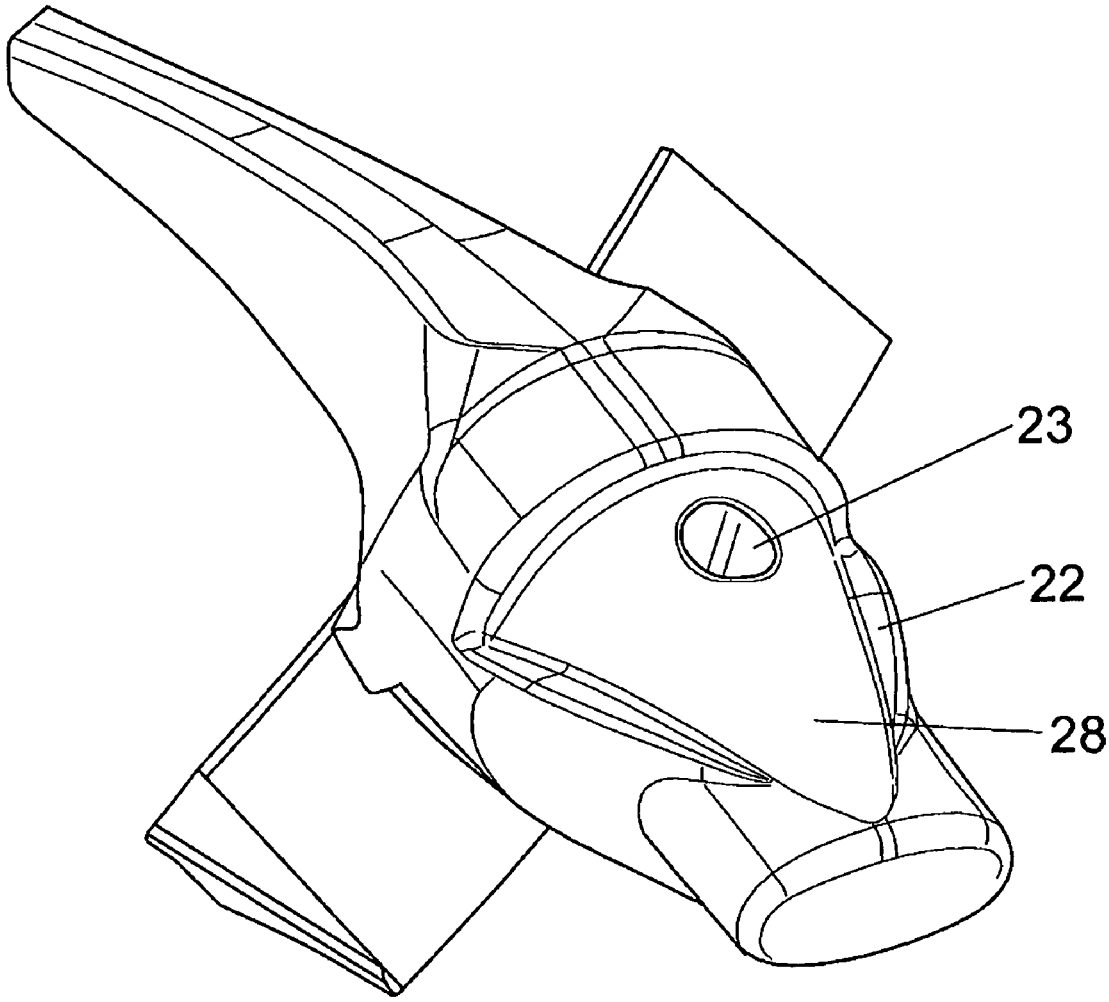
FIG. 23 shows a perspective view of a tooth bar for dredging operations.
Figure 24:
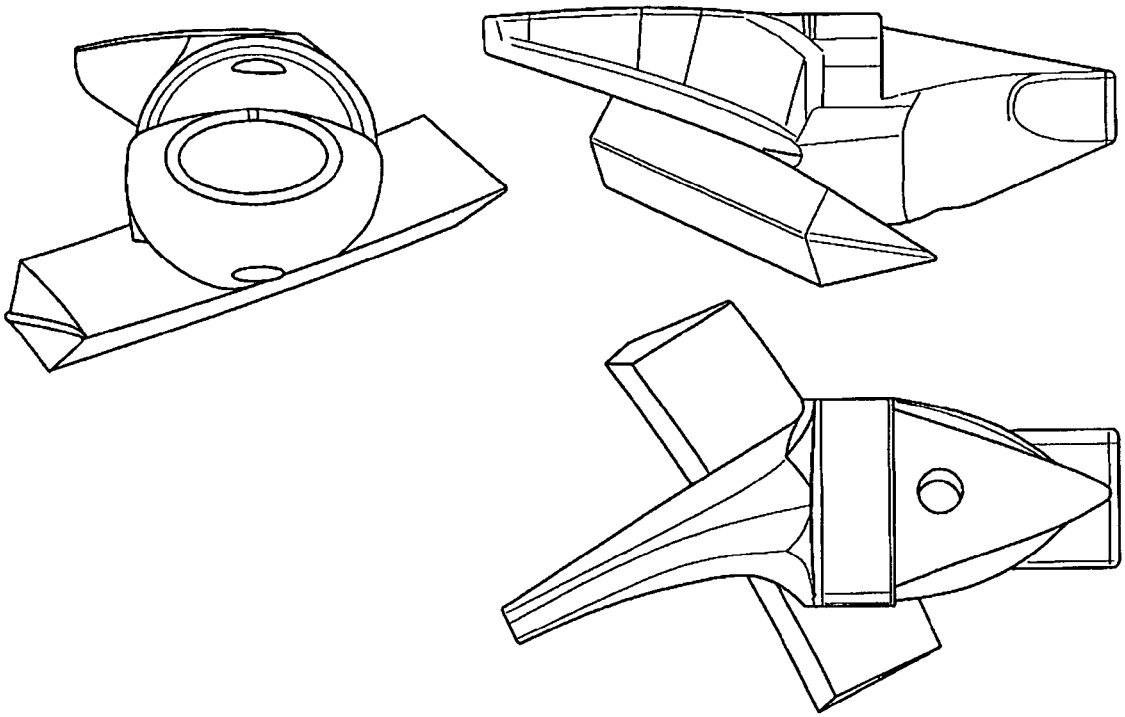
FIG. 24 shows the frontal, side and upper views of the tooth bar of FIG. 23.
Figure 25:
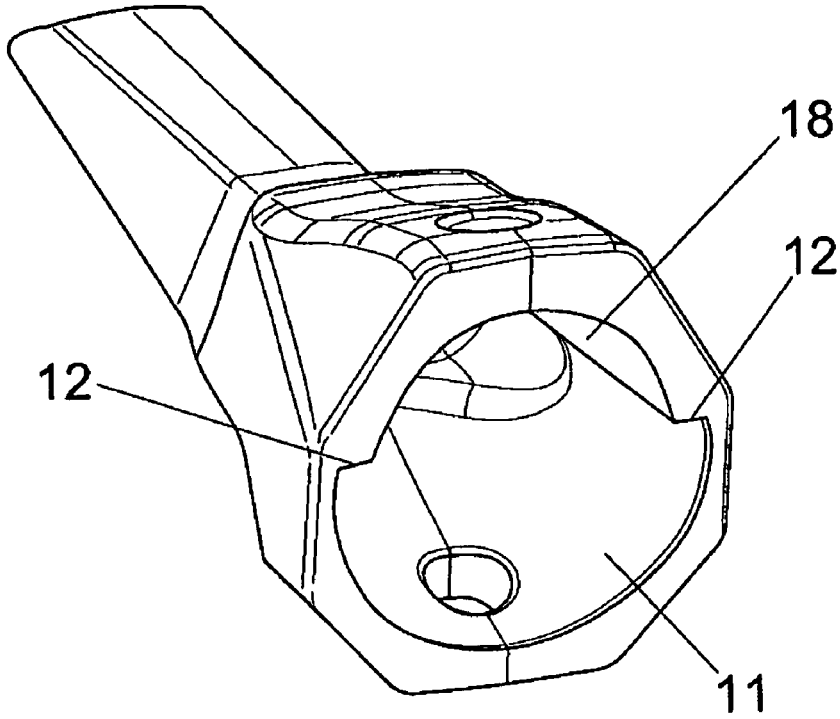
FIG. 25 shows a rear perspective view of a tooth for its coupling in a tooth bar for dredging operations such as the one of FIG. 24.
Figure 26:
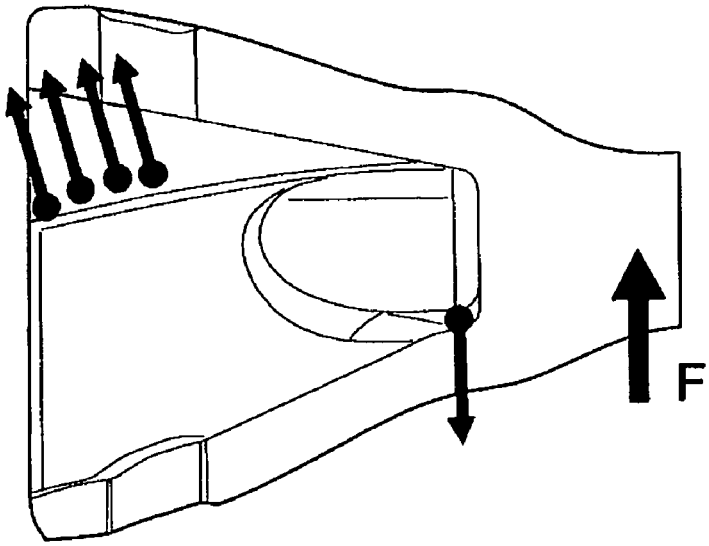
FIG. 26 shows a distribution of forces in the tooth of FIG. 25 upon applying an upward vertical force.

FIG. 22 shows an embodiment variant of the retainer member 8 in which the body 86 is of a generally rectangular or square cross section and said retractable lug 8 has a rectangular or square prismatic proximal portion 81 which is extended with a pyramidal distal portion 82. In any case, the guide runners 61, 62 of the pin 6 have a half-round rounded back cross section and parallel outer edges for contacting with said cylindrical or prismatic proximal portion 81 of the retainer member 8, and the cavity of the pin 6 has inclined outer edges connected with the ramped back or backs of the locking runner 62 in order to make contact with said cone-shaped or pyramidal distal portion 82 of the retainer member 8 and to convert a rotation torque exerted on the pin 6 into a force which is opposed to the force of the resilient means 85 associated to the retainer member 8 in order to retract the lug 8 and release the cavity of the pin 6, whereby the pin 6 is released so as to rotate during a removal or decoupling operation between the tooth 1 and tooth bar 2.

FIG. 22 shows a cross section of the retainer member 8. The body 86 of the retainer member 8 is hollow and has an open lower face susceptible to being closed by a cover and an upper face with a central opening, having a shape conjugated to the cross section of the prismatic or cylindrical proximal portion 81. The lug 8 has a flared inner portion 84 adapted so as to slide on an inner wall of the body 86. There is a space between said flared inner portion 84 of the lug 8 and said open lower wall of the body 86 for housing said resilient means 85. In the illustrated example, these resilient means comprise a stopper 85 of an elastomeric material, such as rubber, polyurethane foam, etc., also compressed or susceptible to being comprised between the flared inner portion 84 of the lug 8 and said cover. Evidently in a similar result, the retainer member could include a single coil spring, a coil spring embedded in elastomeric material, and even a coil spring with a stopper of elastomeric material inside, and the cover could be replaced by any type of removable ring or permanent edge on the lower end of the inner wall of the body 86. The use of one type of retainer member or another will be determined according to the application to which the coupling will be subjected, i.e. if said application is a cold application, either a retainer member solely made up of an elastomer or a spring with elastomer could be used, whereas if working with a hot application, the retainer member will only have a spring.

The retainer member can be directly housed in specially made cavities in the body of the tooth bar.

To assure the coupling between tooth 1 and tooth bar 2, it is necessary to introduce the pin 6 though the opening 13, first introducing the first end 63 where the guide runner 61 begins, making the lug of the retainer member 8 coincide in said guide runner 61 and making the lug 82 slide through the runner 61 until reaching the locking runner 62. At this time it will be necessary to rotate the pin 6 from an initial rotation position located where the guide runner 61 ends and the locking runner 62 begins, to a final rotation position located at the end of the rotation runner 62, coinciding with the second end 64 of said runner where the cavity for receiving the lug of the retainer member 82 is located. Once the lug 82 enters the cavity of the pin 6, the coupling between tooth 1 and tooth bar 2 is assured as the movement of the pin 6 is prevented.

The foregoing is that way because as shown in FIG. 20, the depth of the locking runner 62 decreases in a slope from its first end, coinciding with the end for the guide runner 61, to the second end 64, coinciding with the cavity of the pin. Said ramped surface of the bottom of the locking runner 62 is able to transform a turning torque exerted on the pin 6 into an opposing force to the force of the resilient members 85 of the retractable body 86 able to progressively retract the lug 82 as the pin 6 rotates, until the cavity 64 of the pin 6 is located facing the retainer member 8, at which time the resilient means 85 of the body 86 will be released and will shoot the retainer member 8 into the cavity 64.

Figure 20B:
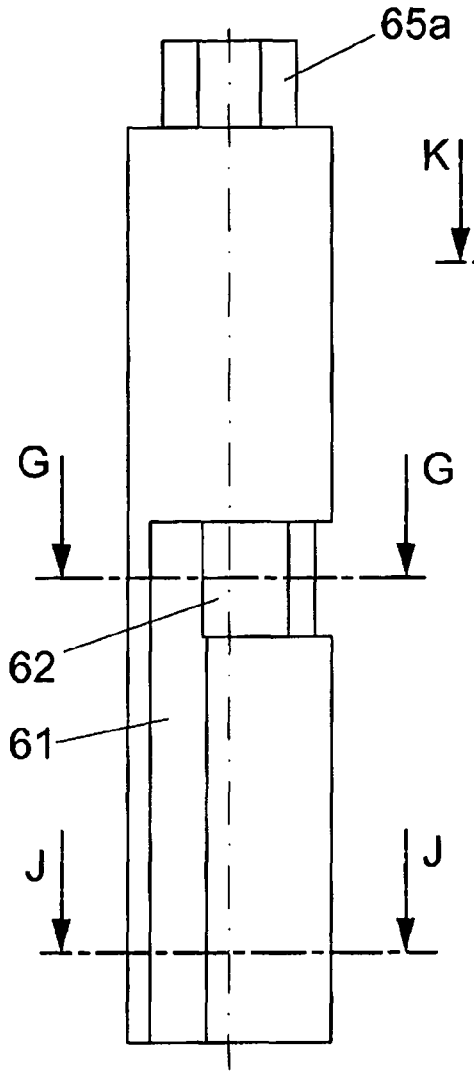
FIG. 20*b* shows a side view of a pin with two guide runners.
Figure 20C:
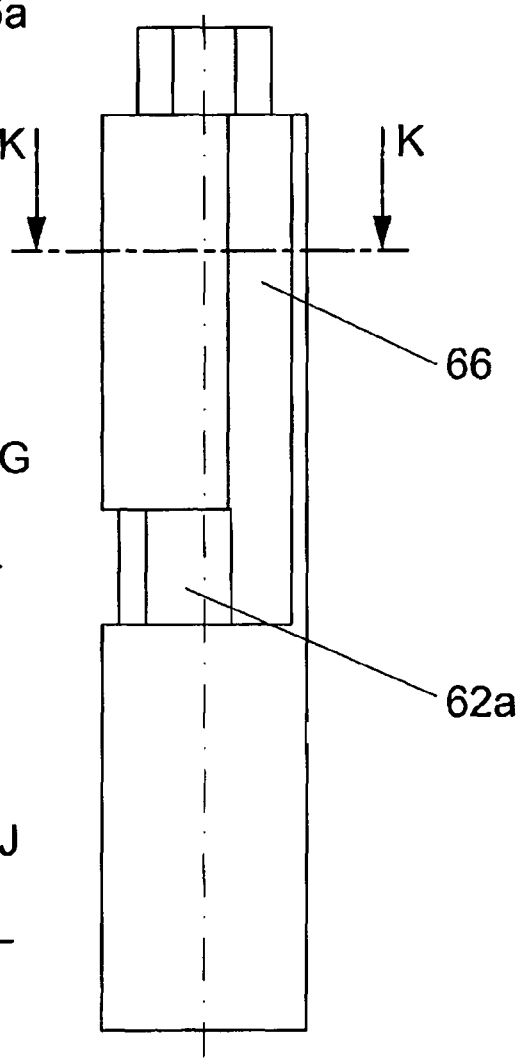
FIG. 20*c* shows a side view of the second guide runner of the pin of FIG. 20*b;*
Figure 20D:
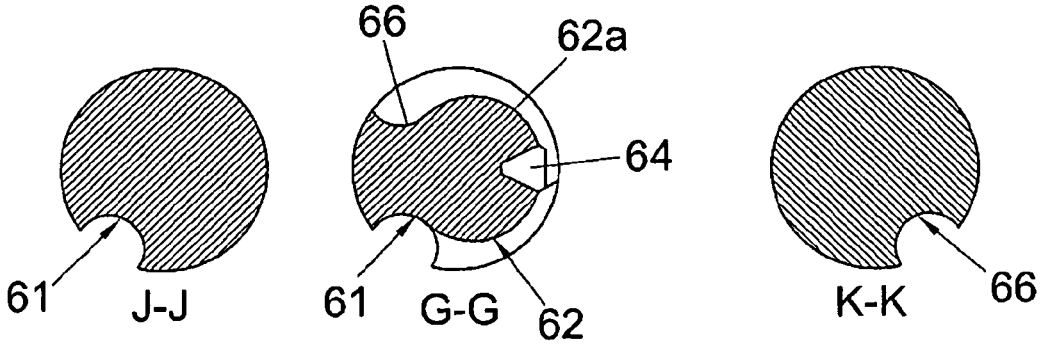
FIG. 20*d* shows a sectional view of the pin of FIGS. 20*b* and 20*c;*
Figure 21:
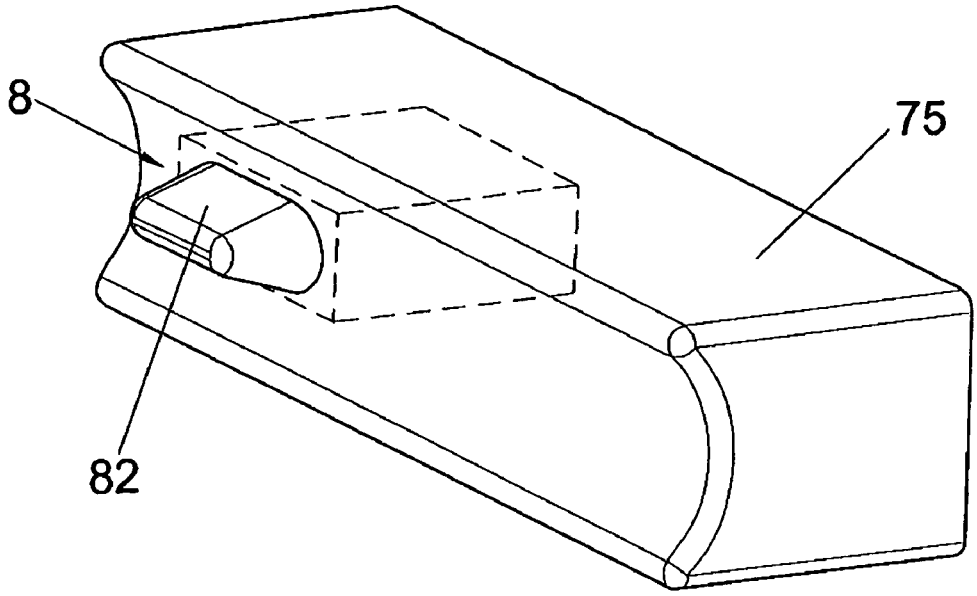
FIG. 21 shows a perspective view of an embodiment of a retainer device.

It is possible for there to be a of the locking runner extension 62*a* after the locking runner 62 and the second end 64, and then after an approximately 90 degree rotation of said runner, a second guide runner 66 is created, such that it is possible to introduce the pin 6 into the housing at either of the two ends thereof. According to this embodiment of the pin, according to FIGS. 20*b*, 20*c* and 20*d*, the cavity 64 of the pin is arranged between the first end and the second end of the locking runner 62, and the pin 6 comprises a second guide runner 66 arranged in a generating direction on said cylindrical surface (since in this case the pin must be cylindrical and not conical as in the previously described embodiments for constructive reasons) with a first end opening into the other one of said opposite bases 65*a* of the pin 6, and a second end connected to said second end 62*a* of the locking runner 62. In this case, the depth of the locking runner also decreases in a slope from its second end to said cavity. It is also possible to arrange a grip configuration 65 different from the previous ones which is outside of the pin 6 rather than being introduced therein.

Another embodiment the arrangement of which is similar to that described above with the exception that in this one the retention body is housed in a housing of the pin rather than in a housing of the tooth bar. Therefore the retainer member is arranged in said housing such that in the absence of an external force, the retractable lug projects from the pin whereas the guide and locking runners are incorporated in the at lease one of said housing configurations defining the passage. The guide runner is arranged in a generating direction in an inner wall of the preferably through opening of the tooth bar. The retention runner is arranged in a circumferential or slightly spiral direction in an inner wall of the through opening, at the mid point there-of, with a first end connected to the end of the guide runner and a second end next to the cavity to receive the retainer member.

In the embodiments, the transverse direction T1 is substantially perpendicular to said longitudinal direction D and substantially parallel to the cutting blade or edge of the machine. However a construction in which the transverse direction T1 were substantially perpendicular to the longitudinal direction D and substantially perpendicular to the cutting blade or edge of the machine would also be possible.

A person skilled in the art will be able to carry out different modifications and variations without departing from the scope of the invention as it is defined in the attached claims. For example, the housing configurations defined in the tooth and tooth bar collaborate to form two passages for two pins retained by respective retainer members. In this case, said two passages would be formed by two pairs of facing openings through opposite areas of the body of the tooth bar and by pairs of facing openings arranged in each one of the upper and lower walls of the tooth.

It is evident that the application of the retention system in the tooth-tooth bar interlocking can be carried out in other positions in addition to the one described, possibly locating it in a vertical housing or using two pins rather than one. It is also evident that the retention system object of the present invention and its different embodiments can be used in other couplings not described.

The use of this retention system in teeth and tooth bars not having the structure of the coupling assembly object of the present application is also possible.

This wear assembly is not limited to its use in machines for moving earth, rather its use is also possible in a dredging machine as can be observed in FIGS. 23 to 26, in which the arrangement of the pin is done so vertically for construction purposes.

Figure 27:
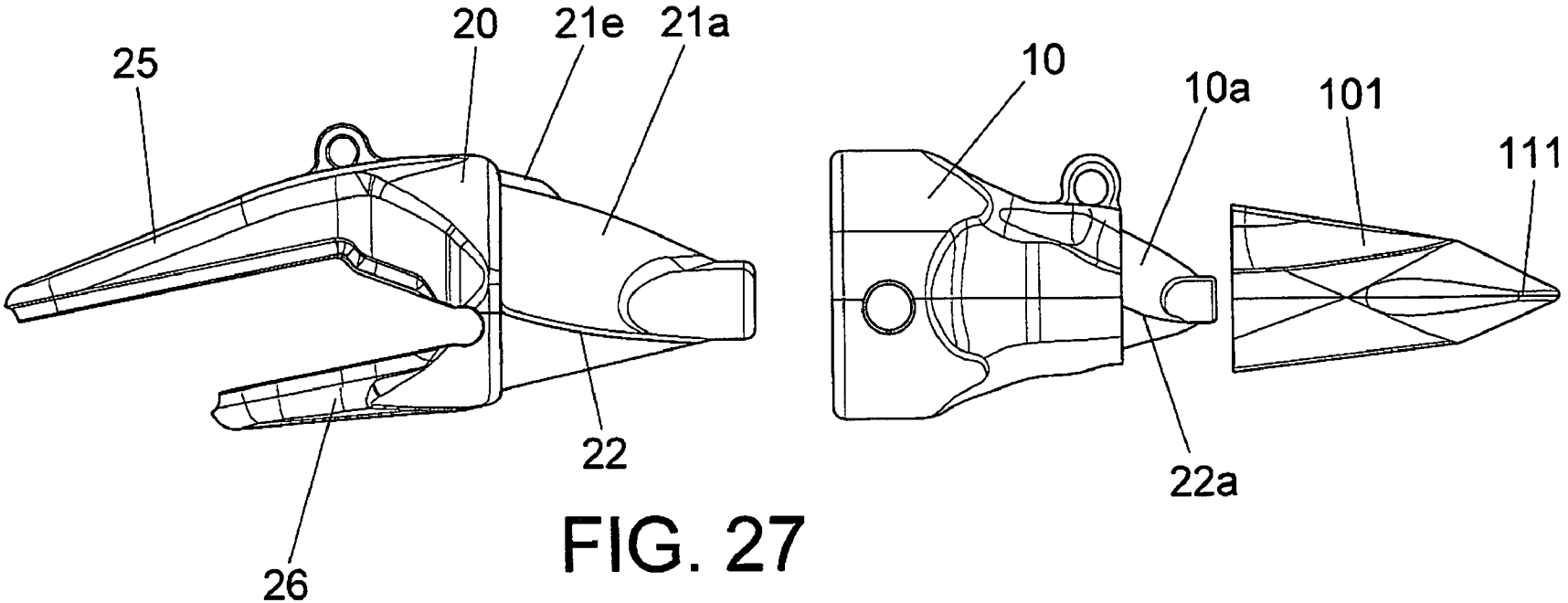
FIG. 27 shows an exploded view of an assembly used in high wear situations of the tip of the tooth, in which a tooth bar, an intermediate tooth and a tip are used, coupled by means of the coupling system object of the present invention.
Figure 28:
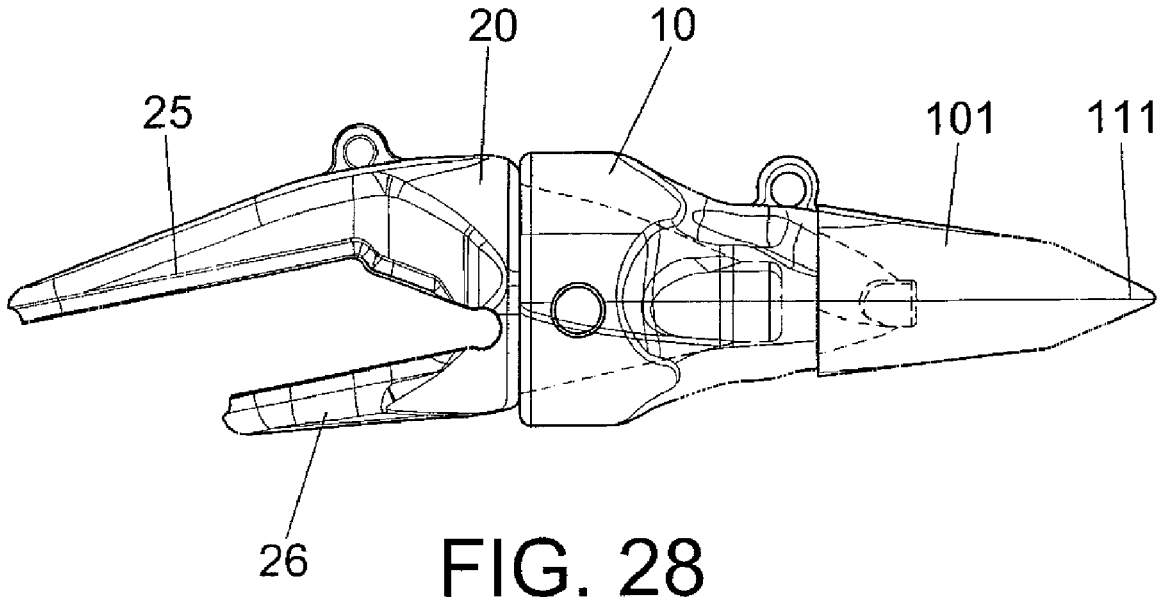
FIG. 28 shows the assembly of FIG. 27, coupled.

On the other hand, as can be observed in FIGS. 27 and 28, it is possible to use the described coupling system in any assembly of two mutually couplable parts, such an intermediate tooth 10 with a nose 10*a* and a tip 101 with a hollow, said intermediate tooth 10 being coupled to a tooth bar 2 through the nose 21*a* of the tooth bar 20 and the hollow of the intermediate tooth. In turn said tooth bar 20 is joined to the blade of the bucket of a machine for moving earth or the like through its rear portion 25, 26.

The invention claimed is:

1. A wear member for being connected to an adaptor in turn joined to a fixing member, the wear member being of the type comprising a body with a hollow, cavity or open box in a rear portion thereof for receiving a projecting area or nose projecting from a front portion of an adaptor member, and at least one opening communicating said hollow with the outside for the subsequent introduction of a pin, wherein the hollow, cavity or open box, conjugated with the projecting area or nose of the adaptor, is symmetrical with respect to the vertical axis and comprises:

a proximal portion of decreasing cross section ending in a distal portion of continuous cross section, said decreasing section being formed by two decreasing superimposed sections, one having a larger surface than the other one, coinciding in size and shape in the distal portion of the hollow and which in the proximal portion, the smaller surfaced section partially projects at the lower portion of the larger surfaced section such that, along the length of the hollow defined between the proximal portion and the distal portion, the smaller surfaced section projecting at the lower portion of the larger surfaced section is progressively introduced into the larger surfaced section up to a point in which said smaller surfaced section is hidden inside the larger surfaced section, said point being located in the proximal portion, and at least two interlocking surfaces along the proximal portion of the hollow defining the union of the series of smaller surfaced sections with the series of larger surfaced sections.

2. The wear member according to claim 1, wherein the hollow has two interlocking surfaces which, due to their conjugated configuration with the surface of the nose of the adaptor member, allow that:

a force applied on the wear member in a downward transverse direction creates a force component in the interlocking surfaces in the longitudinal interlocking direction of the wear member to the adaptor member, the contact between the conjugated interlocking surfaces prevents the wear member from being extracted from the adaptor member in a rectilinear extraction length, and the wear member is retained by the adaptor.

3. The wear member according to claim 1, wherein the larger surfaced sections and the smaller surfaced sections are substantially elliptical or oval-shaped, defining in the proximal portion a half cone-shaped body of revolution in the upper portion of the hollow with respect to the horizontal or transverse axis and a half cone-shaped body of revolution in the lower portion of the hollow with respect to said axis.

4. The wear member according to claim 1, wherein the union of the smaller surfaced section with the larger surfaced section is carried out by means of a rectilinear line with a variable inclination between 0 degrees and 60 degrees with respect to the vertical axis of symmetry of the wear member or of the adaptor member, a straight plane defining the series of the infinite sections.

5. The wear member according to claim 4, wherein the union of the smaller surfaced section with the larger surfaced section is carried out by means of a rectilinear line with a variable inclination between 10 degrees and 20 degrees with respect to the axis of symmetry of the wear member or adaptor member.

6. The wear member according to claim 4, wherein the union of the smaller surfaced section with the larger surfaced section is carried out by means of a rectilinear line with an inclination of 0 degrees with respect to the axis of symmetry of the wear member.

7. The wear member according to claim 4, wherein the union of the smaller surfaced section with the larger surfaced section is carried out by means of two rectilinear lines forming an acute angle with one another in their extension towards the upper and lower portion of the hollow.

8. The wear member according to claim 4, wherein the union of the smaller surfaced section with the larger surfaced section is carried out by means of two rectilinear lines forming an obtuse angle with one another in their extension towards the upper and lower portion of the hollow.

9. The wear member according to claim 1, wherein the union of the smaller surfaced section with the larger surfaced section is carried out by means of a rectilinear line, a curved plane defining the series of infinite sections.

10. The wear member according to claim 9, wherein the union of the smaller surfaced section with the larger surfaced section is carried out by means of a convex rectilinear line with a given radius of curvature.

11. The wear member according to claim 9, wherein the union of the smaller surfaced section with the larger surfaced section is carried out by means of a concave rectilinear line with a given radius of curvature.

12. The wear member according to claim 1, wherein the wear member is a tooth for use in machines for moving materials such as earth or stones.

13. The wear member according to claim 1, wherein the larger surfaced section is directly above the smaller surfaced section when viewed along a direction of insertion of the adaptor into the hollow.

14. An adaptor member for being connected to a fixing member, of the type comprising a body with a projecting area or nose projecting from a front portion for being housed in a hollow, cavity or open box existing in a rear portion of a wear member, said adaptor member having fixing means in a rear portion and at least one passage through the projecting area for the introduction of a pin, wherein the projecting area or nose, conjugated with the hollow of the wear member, is symmetrical with regard to the vertical axis and comprises:

a proximal portion of decreasing cross section ending in a distal portion of continuous cross section, said decreasing section being formed by two decreasing superimposed sections, one having a larger surface than the other one, coinciding in size and shape in the distal portion of the nose and which in the proximal portion, the smaller surfaced section partially projects at the lower portion of the larger surfaced section such that, along the length of the nose defined between the proximal portion and the distal portion, the smaller surfaced section projecting at the lower portion of the larger surfaced section at the beginning of the proximal area is progressively introduced into the larger surfaced section up to a point in which said smaller surfaced section is hidden inside the larger surfaced section, said point being located in the proximal portion, and at least two interlocking surfaces along the proximal portion of the nose defining the union of the series of smaller surfaced sections with the series of larger surfaced sections.

15. The adaptor according to claim 14, wherein the projecting area or nose has two interlocking surfaces which, due to their conjugated configuration with the surface of the hollow of the wear member, allowed that:

a force applied on the wear member in a downward transverse direction creates a force component in the interlocking surfaces in the longitudinal interlocking direction of the wear member to the adaptor member, the contact between the conjugated interlocking surfaces prevents the wear member from being extracted from the adaptor member in a rectilinear extraction length, and the wear member is retained by the adaptor.

16. The adaptor according to claim 14, wherein the larger surfaced sections and the smaller surfaced sections are substantially elliptical or oval-shaped, defining in the proximal portion a half cone-shaped body of revolution in the upper portion of the nose with respect to the horizontal or transverse axis and a half cone-shaped body of revolution in the lower portion of the nose with respect to said axis.

17. The adaptor according to claim 14, wherein the union of the smaller surfaced section with the larger surfaced section defining the interlocking surfaces is carried out by means of a rectilinear line with a variable inclination between 0 degrees and 60 degrees with respect to the axis of symmetry of the wear member or of the adaptor member, a straight plane defining the series of the infinite sections.

18. The adaptor member according to claim 17, wherein the union of the smaller surfaced section with the larger surfaced section is carried out by means of a rectilinear line with a variable inclination between 10 and 20 degrees with respect to the axis of symmetry of the wear member or adaptor member.

19. The adaptor member according to claim 17, wherein the union of the smaller surfaced section with the larger surfaced section is carried out by means of rectilinear lines forming an acute angle with one another in their extension towards the upper and lower portion of the nose.

20. The adaptor member according to claim 17, wherein the union of the smaller surfaced section with the larger surfaced section is carried out by means of rectilinear lines forming an obtuse angle with one another in their extension towards the upper and lower portion of the nose.

21. The adaptor member according to claim 14, wherein the union of the smaller surfaced section with the larger surfaced section is carried out by means of a rectilinear line, two interlocking surfaces formed by curved planes defining the series of infinite sections.

22. The adaptor member according to claim 21, wherein the union of the smaller surfaced section with the larger surfaced section is carried out by means of a convex rectilinear line with a given radius of curvature.

23. The adaptor member according to claim 21, wherein the union of the smaller surfaced section with the larger surfaced section is carried out by means of a concave rectilinear line with a given radius of curvature.

24. The adaptor according to claim 14, wherein the adaptor is a tooth bar for use in machines for moving materials such as earth or stones.

25. The adaptor member according to claim 14, wherein the larger surfaced section is directly above the smaller surfaced section when viewed along a direction of insertion of the adaptor into the hollow.

26. A wear assembly for being connected to a fixing member wherein the wear assembly comprises:

a wear member according to claim 1, and an adaptor member having fixing means in a rear portion and at least one passage through the projecting area for the introduction of a pin, wherein the projecting area or nose, conjugated with the hollow of the wear member, is symmetrical with regard to the vertical axis and comprises:

a proximal portion of decreasing cross section ending in a distal portion of continuous cross section, said decreasing section being formed by two decreasing superimposed sections, one having a larger surface than the other one, coinciding in size and shape in the distal portion of the nose and which in the proximal portion, the smaller surfaced section partially projects at the lower portion of the larger surfaced section such that, along the length of the nose defined between the proximal portion and the distal portion, the smaller surfaced section projecting at the lower portion of the larger surfaced section at the beginning of the proximal area is progressively introduced into the larger surfaced section up to a point in which said smaller surfaced section is hidden inside the larger surfaced section, said point being located in the proximal portion, and at least two interlocking surfaces along the proximal portion of the nose defining the union of the series of smaller surfaced sections with the series of larger surfaced sections, and the wear assembly further comprising:

a retention system assuring the fixing of the wear member in the adaptor.

* * * * *